US007767374B2

(12) United States Patent
Kihara et al.

(10) Patent No.: US 7,767,374 B2
(45) Date of Patent: Aug. 3, 2010

(54) METHOD FOR PRODUCING ELECTROPHOTOGRAPHIC PHOTORECEPTOR HAVING SUBLIMABLE ANTIOXIDANT IN COATING LIQUID

(75) Inventors: Akiko Kihara, Nara (JP); Rikiya Matsuo, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 873 days.

(21) Appl. No.: 11/638,563

(22) Filed: Dec. 14, 2006

(65) Prior Publication Data

US 2007/0141505 A1 Jun. 21, 2007

(30) Foreign Application Priority Data

Dec. 15, 2005 (JP) ..... P2005-362382

(51) Int. Cl.
*G03G 5/047* (2006.01)

(52) U.S. Cl. ..... 430/133; 430/134; 430/970; 430/58.05

(58) Field of Classification Search ..... 430/133, 430/134, 970
See application file for complete search history.

(56) References Cited

U.S. PATENT DOCUMENTS

| | | | | |
|---|---|---|---|---|
| 5,130,222 | A | 7/1992 | Otsuka et al. | |
| 6,048,658 | A * | 4/2000 | Evans et al. | 430/132 |
| 6,214,514 | B1 * | 4/2001 | Evans et al. | 430/133 |
| 2004/0115545 | A1 * | 6/2004 | Horgan et al. | 430/58.8 |
| 2004/0115547 | A1 * | 6/2004 | Tong et al. | 430/59.6 |
| 2005/0019682 | A1 | 1/2005 | Inagaki et al. | |
| 2005/0271958 | A1 * | 12/2005 | Tong et al. | 430/59.6 |
| 2006/0257767 | A1 * | 11/2006 | Tong et al. | 430/58.8 |
| 2006/0286471 | A1 * | 12/2006 | Mishra et al. | 430/58.8 |
| 2007/0082282 | A1 * | 4/2007 | Mishra et al. | 430/58.05 |

FOREIGN PATENT DOCUMENTS

| | | | |
|---|---|---|---|
| EP | 420580 | A * | 4/1991 |
| JP | 62-105151 | | 5/1987 |
| JP | 02-146556 | | 6/1990 |
| JP | 08-292587 | | 11/1996 |
| JP | 10-282696 | | 10/1998 |

(Continued)

OTHER PUBLICATIONS

Grant, Roger and Clarie Grant. Chemical Dictionary. New York: McGraw-Hill, Inc. (1987) p. 446, "photoconductivity".*

*Primary Examiner*—Christopher RoDee
(74) *Attorney, Agent, or Firm*—Nixon & Vanderhye P.C.

(57) ABSTRACT

An method for producing an electrophotographic proreceptor includes a first coating step of applying a coating liquid containing a sublimable antioxidant and a photoconductive substance, onto a conductive substrate to form a first coating film thereon, a first drying step of drying the formed first coating film by heating to form a first photosensitive layer, a second coating step of applying the coating liquid used in the first coating step, onto the first photosensitive layer to form a second coating film, and a second drying step of drying the formed second coating film by heating to form a second photosensitive layer. In the second drying step, the drying condition is made to differ from the drying condition in the first drying step so that a degree of sublimation of the antioxidant in the second drying step is lower than that of sublimation of the antioxidant in the first drying step.

5 Claims, 5 Drawing Sheets

FOREIGN PATENT DOCUMENTS

| | | | |
|---|---|---|---|
| JP | 2004-251967 | | 9/2004 |
| JP | 2005-43398 | A | 2/2005 |
| JP | 2005-43443 | A | 2/2005 |
| JP | 2005148318 | A | * 6/2005 |
| JP | 2005326474 | A | * 11/2005 |

* cited by examiner

METHOD FOR PRODUCING ELECTROPHOTOGRAPHIC PHOTORECEPTOR HAVING SUBLIMABLE ANTIOXIDANT IN COATING LIQUID

CROSS-REFERENCE TO RELATED APPLICATION

This application claims priority to Japanese Patent Application No. JP 2005-362382, which was filed on Dec. 15, 2005, the contents of which, are incorporated herein by reference, in their entirety.

BACKGROUND OF THE INVENTION

1. Field of the Invention

The present invention relates to a method for producing an electrophotographic photoreceptor, and to an electrophotographic photoreceptor and an image forming apparatus.

2. Description of the Related Art

An electrophotographic photoreceptor (hereinafter this may be simply referred to as "photoreceptor") has a constitution of a photoconductive substance-containing photosensitive layer laminated on a conductive substrate. One example of the electrophotographic photoreceptor is an inorganic photoreceptor in which the photosensitive layer comprises an inorganic photoconductive substance such as selenium, zinc oxide or cadmium sulfide as the essential ingredient thereof.

The basic characteristics necessary for the photoreceptor are that it has good electric properties, for example, it has good charge-retentive capability and discharges little in a dark place, it has good photosensitivity and readily discharges through exposure to light. The others also necessary for the photoreceptor are that its electric properties as above are stable even in repeated use so that it can form homogeneous images for a long period of time, and it has good electric characteristic stability (this may be hereinafter simply referred to as "characteristic stability").

The inorganic photoreceptor may have such basic properties of photoreceptor, but has some drawbacks in that its photosensitive layer is difficult to form, its surface is poorly plastic and is readily scratched, and its production costs are high. In addition, the inorganic photoconductive substance mentioned above is highly toxic and is seriously limited in point of its production and use.

In place of the inorganic photoreceptor using such an inorganic photoconductive substance, an organic photoreceptor using an organic photoconductive substance is being studied and developed. An organic photoconductive substance is being widely studied and developed, and it is utilized not only in electrostatic recording devices such as electrophotographic photoreceptors but also applied to sensors, organic electroluminescent devices, etc.

The organic photoreceptor using an organic photoconductive substance has the advantages that the photosensitive layer is easy to form and is highly plastic, and that the layer is lightweight and its transparency is good. In addition, another advantage of the organic photoreceptor is that, according to a method of adding a chemical sensitizer or an optical sensitizer thereto, the photoreceptor may be made to generate free charges to light having a broad wavelength range and its photosensitivity may be thereby bettered. Though the organic photoreceptor has one problem in that its durability is somewhat poorer than that of the inorganic photoreceptor, it is the mainstream of electrophotographic photoreceptors as having the above-mentioned various advantages.

As one type of the organic photoreceptor, a function-separated electrophotographic photoreceptor has been developed, of which the charge-generating function and the charge-transporting function are separately attained by different substances. In the function-separated electrophotographic photoreceptor of the type, different substances are used for the charge-generating substance that bears the charge-generating function thereof and for the charge-transporting substance that bears the charge-transporting function thereof. Accordingly, the materials to be used for the charge-generating substance and for the charge-transporting substance may be readily selected, and the photosensitivity of the organic photoreceptor may be thereby further bettered, and therefore electrophotographic photoreceptors having any desired properties may be produced relatively easily.

The function-separated photoreceptor is grouped into two; one is a single-layered photoreceptor having a photosensitive layer in which a charge-generating substance and a charge-transporting substance are co-dispersed in a resin having a binding capability that is referred to as a binder resin, and the other is a laminate-structured photoreceptor having a laminate photosensitive layer that comprises a charge-generating layer with a charge-generating substance dispersed therein and a charge-transporting layer with a charge-transporting substance dispersed therein. Both the single-layered photoreceptor and the laminate-structured photoreceptor are produced according to a process that comprises a coating step of applying a coating liquid, which is prepared by dissolving or dispersing a photosensitive layer-forming material that comprises an organic photoconductive substance including a charge-generating substance or a charge-transporting substance, and a resin having a binding capability that is referred to as a binder resin, in a solvent capable of dissolving the binder resin, onto a conductive substrate to form thereon a layer having a uniform thickness (hereinafter the coating liquid applied to the conductive substrate is referred to as "coating film"), and a drying step of drying the coating film to thereby remove the solvent having remained in the coating film.

For the laminate-structure photoreceptor, much used is a normal two-layered photoreceptor that comprises a charge-generating layer formed on the side of the conductive substrate and a charge-transporting layer formed on the outer surface side of the photoreceptor, or that is, on the opposite side to the conductive substrate relative to the charge-generating layer. In the normal two-layered photoreceptor, the charge-transporting layer is laminated on the surface of the charge-generating layer, or that is, on the opposite side to the conductive substrate relative to the charge-generating layer, and the charge-transporting layer has a hole-transporting function. Therefore, the photoreceptor of the type is sensitive to light while it is charged negatively, and it is essentially used under negative charge. On the other hand, a reverse two-layered photoreceptor has been developed as a laminate-structure photoreceptor usable under positive charge, in which a charge-transporting layer is formed on the conductive substrate side of the photoreceptor and a charge-generating layer is formed on the surface side thereof.

As in the above, various types of organic photoreceptors have been proposed. These organic photoreceptors may satisfy various requirements in a broad range, but have some problems common to them in that the characteristic stability of organic photoreceptors is insufficient. Organic photoreceptors undergo fatigue degradation in repeated use, such as charge potential reduction or residual potential increase. As a result, an image forming apparatus that comprises such an organic photoreceptor may have some problems of resolution reduction and image failure of white skipping or dark stripes. White skipping means a phenomenon of such that toner does not adhere to a part to which it should adhere. Dark stripes mean a phenomenon of such that toner adheres to a part to which it should adhere and erroneously even to another part except it, like stripes.

The fatigue degradation of a photoreceptor to worsen its characteristic stability may be caused by a charger used as a charging unit for charging the photoreceptor. Concretely, a photoreceptor may be fatigued and degraded by an oxidizing gas such as ozone generated through corona discharge by a charger driven according to a corona discharge system (hereinafter, this may be referred to as "corona-discharge charger") and nitrogen oxide to be formed through reaction of the generated ozone with nitrogen in air. The oxidizing gas oxidizes the photoconductive substance that exists on and around the outer surface of a photoreceptor having a photosensitive layer formed on the outer surface side thereof. When the photoreceptor is repeatedly used and when the photoconductive substance is oxidized, then the photosensitive layer may be fatigued and degraded through the oxidation of the photoconductive substance, and the life of the photoreceptor is thereby shortened.

For solving the problem of fatigue degradation of the photosensitive layer, one method is proposed, which comprises providing an exhaust unit inside an image forming apparatus on which a photoreceptor is mounted, and exhausting the oxidizing gas around the corona-discharge charger. Providing an exhaust unit inside an image forming apparatus in that manner may make it possible to exhaust the oxidizing gas around the corona-discharge charger and to prevent the oxidation of the photoconductive substance, but this is problematic in that the constitution of the image forming apparatus may be complicated.

Another method has been tried, which comprises using a bisphenol Z-type polycarbonate resin having an excellent gas-barrier capability as the binder resin for a photosensitive layer, thereby improving the gas-barrier property of the surface of the photosensitive layer and improving the oxidizing gas transmission resistance of the photosensitive layer so as to prevent the fatigue degradation of the photosensitive layer. However, a photosensitive layer capable of exhibiting a sufficient gas-barrier property not detracting from the electric properties of the photoconductive substance in the photosensitive layer has not as yet been realized.

For preventing the oxidation by an oxidizing gas of the photoconductive substance existing around the surface of a photosensitive layer, a method has been proposed, which comprises adding an antioxidant, a stabilizer or the like to the photosensitive layer. For example, proposed is adding a hindered phenol-type antioxidant such as a compound having a triazine ring and a hindered phenol skeleton, to a photosensitive layer (e.g., see Japanese Unexamined Patent Publication JP-A 62-105151 (1987)).

As another prior-art technique, proposed is adding, as an additive, a hindered phenol-type antioxidant of a hindered phenol skeleton-having compound, or a phosphite-type antioxidant or an amine-type antioxidant, to a photosensitive layer that contains a specific arylamine compound (e.g., see Japanese Unexamined Patent Publication JP-A 8-292587 (1996)). As still another prior-art technique, proposed is adding a hindered amine skeleton-having compound and a specific structure-having amine compound such as tribenzylamine to a photosensitive layer (e.g., see JP-A 8-292587).

The hindered phenol skeleton-having compound disclosed in these prior-art references is a phenol compound having a bulky substituent such as a branched alkyl group, a cycloalkyl group, an aryl group or a heterocyclic group, in the position adjacent to the phenolic hydroxyl group therein. The hindered amine structure-having compound is an amine compound in which the hydrogen atom of the amino group is substituted with a bulky substituent such as a branched alkyl group, a cycloalkyl group, an aryl group or a heterocyclic group.

When the antioxidant disclosed in JP-A 62-105151, JP-A 8-292587, Japanese Unexamined Patent Publication JP-A 10-282696 (1998) is added to a photosensitive layer, then the oxidation of the photoconductive substance in the layer by an oxidizing gas may be prevented and the fatigue degradation of the photoreceptor may be thereby prevented. However, when the antioxidant is added to the photosensitive layer in such a degree that the oxidation of the photoconductive substance can be thereby prevented, then there may occur some problems in that the photosensitivity of the photoreceptor is lowered or the photo-responsiveness thereof is lowered owing to the change in the sensitive wavelength range, and while the photoreceptor is used repeatedly in an electrophotographic process comprising a series of charging, exposure and discharging, its charge potential may lower and its residual potential may increase. In order to evade these problems, when the amount of the antioxidant to be added is reduced, then the oxidation of the photoconductive substance could not be sufficiently prevented. To that effect, the prior-art techniques could not realize a photoreceptor capable of satisfying both good electric properties and good resistance to oxidizing gas.

To solve these problems, proposed is another technique of making a hindered amine skeleton-having compound (hereinafter, this may be referred to as hindered phenol compound) serving as an antioxidant exist in the surface of a photosensitive layer, not adding such an antioxidant to the constitutive material itself of the photosensitive layer (e.g., see JP-A 2-146556 (1990)). The technique disclosed in JP-A 2-146556 (1990) is to propose forming a hindered amine compound-containing protective layer on the surface of a photosensitive layer, by supplying a hindered amine compound to the surface of a photosensitive layer through contact of a contact member such as an elastic roller or an elastic blade with a photoreceptor. According to the technique of making an antioxidant exist in the surface of a photosensitive layer in the manner as above, the photoconductive substance existing in the photosensitive layer around the outer surface of the photoreceptor may be prevented from being oxidized by an oxidizing gas, and the characteristic stability of the photoreceptor may be thereby prevented from being lowered. In addition, since the photosensitive layer itself does not contain an antioxidant, the electric properties of the photoreceptor do not lower.

The technique disclosed in JP-A 2-146556 (1990) may be effective for preventing the oxidation of a photoconductive substance by an oxidizing gas, but has the following problems. For example, in case where a hindered amine compound is supplied to the surface of a photoreceptor through contact of a contact member such as an elastic roller or an elastic blade with a photoreceptor, the elastic material to constitute the contact member must contain a hindered amine compound. The process of producing such a contact member is complicated, and, depending on the contact pressure between the contact member and a photoreceptor, a sufficient amount of a hindered amine compound enough for the intended oxidizing gas resistance could not be supplied to the surface of the photoreceptor. When the contact pressure between the contact member and the photoreceptor is increased in order that a sufficient amount of a hindered amine compound could be supplied to the surface of the photoreceptor, then the photosensitive layer, or that is, the surface layer of the photoreceptor may be worn by the contact pressure and the thickness of the photosensitive layer may be thereby reduced, and there may occur other problems in that the electric properties of the layer may be worsened and the life of the photoreceptor may be shortened.

When a hindered amine compound is added to the protective layer provided on the surface of a photosensitive layer, then the protective layer must be indispensably formed in a photoreceptor with the result that the types of the coating liquids to be used in producing a photoreceptor increase. In forming a photoreceptor, the viscosity of the coating liquid is an important physical factor for defining the thickness dimension of the photosensitive layer, and it is an indispensable condition to highly accurately control the viscosity of the coating liquid for efficiently producing a photoreceptor. Accordingly, increasing the types of the coating liquids results in other various problems in that the control of the coating liquids is complicated, the plant investment for viscosity control increases, and the production costs increase in point of the material such as the solvent to be used for the viscosity control since a fresh solvent must be replenished for compensating the solvent that may reduce through vaporization.

To solve these problems, desired is a simple method for increasing the resistance of the photosensitive layer to an oxidizing gas and for preventing the reduction in the characteristic stability of a photoreceptor, not increasing the types of the necessary coating liquids relative to the number of the photosensitive layers to be formed and not detracting from the electric properties of the photoreceptor.

SUMMARY OF THE INVENTION

An object of the invention is to provide a simple method for producing an electrophotographic photoreceptor capable of improving the resistance of a photosensitive layer to an oxidizing gas and capable of preventing the degradation of the electric properties of the electrophotographic photoreceptor and preventing the reduction in the characteristic stability thereof, not increasing the types of the necessary coating liquids over the number of the photosensitive layers to be formed of the coating liquids; and to provide an electrophotographic photoreceptor and an image forming apparatus.

The invention provides a method for producing an electrophotographic photoreceptor having at least a first photosensitive layer and a second photosensitive layer laminated in that order on a conductive substrate, the method comprising:

a first coating step of applying a coating liquid that contains a sublimable antioxidant and a photoconductive substance, onto a conductive substrate to thereby form a first coating film thereon;

a first drying step of drying the formed first coating film by heating to thereby form a first photosensitive layer;

a second coating step of applying the coating liquid used in the first coating step, onto the first photosensitive layer to thereby form a second coating film;

a second drying step of drying the formed second coating film by heating to thereby form a second photosensitive layer;

wherein, in the second drying step, the drying condition for the second coating film is made to differ from the drying condition for the first coating film in the first drying step so that a degree of sublimation of the antioxidant in the second drying step is lower than that of sublimation of the antioxidant in the first drying step.

According to the invention, a method for producing an electrophotographic photoreceptor having at least a first photosensitive layer and a second photosensitive layer laminated in that order on a conductive substrate, comprises a first coating step of applying a coating liquid that contains a sublimable antioxidant and a photoconductive substance, onto a conductive substrate to thereby form a first coating film thereon; a first drying step of drying the formed first coating film by heating to thereby form a first photosensitive layer; a second coating step of applying the coating liquid used in the first coating step, onto the first photosensitive layer to thereby form a second coating film; and a second drying step of drying the formed second coating film by heating to thereby form a second photosensitive layer, and in the second drying step, the drying condition for the second coating film is made to differ from the drying condition for the first coating film in the first drying step so that a degree of sublimation of the antioxidant in the second drying step is lower than that of sublimation of the antioxidant in the first drying step.

Accordingly, by using an antioxidant having a sublimable capability (hereinafter this may be referred to as "sublimable antioxidant"), and making in the second drying step, the drying condition differ from that in the first drying step so that the degree of sublimation of the antioxidant in the second drying step is lower than the degree of sublimation of the antioxidant in the first drying step, the content of the antioxidant remaining in the formed second photosensitive layer may be made higher than the content of the antioxidant remaining in the formed first photosensitive layer. Accordingly, in the second photosensitive layer, which is remoter from the conductive substrate than the first photosensitive layer and which is nearer to the surface of the electrophotographic photoreceptor, the content of the antioxidant may be made higher than in the first photosensitive layer, and therefore the photoconductive substance existing in and around the surface of the second photosensitive layer may be prevented from being oxidized. As a result, the resistance to an oxidizing gas of the photosensitive layer that includes the first photosensitive layer and the second photosensitive layer may be improved. In the first photosensitive layer that is remoter from the surface of the electrophotographic photoreceptor than the second photosensitive layer, the content of the antioxidant may be smaller than in the second photosensitive layer, and therefore the electric properties of the first photosensitive layer are prevented from being worsened. In that manner, the resistance to an oxidizing gas of the electrophotographic photoreceptor thus produced herein may be increased and therefore the electrophotographic photoreceptor may have excellent characteristic stability, and, in addition, the overall photosensitive layer of the electrophotographic photoreceptor may have good electric properties.

Using the same coating liquid but making the degree of sublimation of the antioxidant therein differ from each other, the first photosensitive layer and the second photosensitive layer may be formed that have a different antioxidant content. To that effect, since the same coating liquid is used for forming different layers, the type of the coating liquid for forming photosensitive layers does not increase. Accordingly, in the invention, the control of the coating liquids is not complicated, the plant investment for the viscosity control does not increase, and the production costs do not increase in point of the solvent to be used for the viscosity control.

In the invention, it is preferable that the photoconductive substance is a charge-transporting substance, the first photosensitive layer is a first charge-transporting layer, and the second photosensitive layer is a second charge-transporting layer.

According to the invention, the photoconductive substance is a charge-transporting substance, the first photosensitive layer is a first charge-transporting layer, and the second photosensitive layer is a second charge-transporting layer, so that the content of the antioxidant in the second charge-transporting layer may be made higher than the content of the antioxidant in the first charge-transporting layer. Accordingly, in the second charge-transporting layer, which is remoter from the conductive substrate than the first charge-transporting layer and which is nearer to the surface of the electrophotographic photoreceptor, the content of the antioxidant may be made higher than that in the first charge-transporting layer, and the oxidation of the charge-transporting substance in the second charge-transporting layer may be thereby prevented. In addition, since the content of the antioxidant in the first charge-transporting layer is smaller than that in the second charge-transporting layer, the degradation of the electric properties of the first charge-transporting layer that may be caused by the increase in the antioxidant in the layer could be prevented. Accordingly, the electrophotographic photoreceptor produced herein may have excellent electric properties and excellent characteristic stability and may be resistant to oxidizing gas, as a whole of the charge-transporting layer that includes the first charge-transporting layer and the second charge-transporting layer.

In the invention, it is preferable that the sublimable antioxidant is a hindered phenol compound of the following general formula (1):

(1)

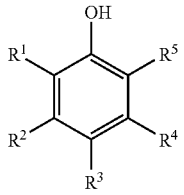

wherein $R^1$ represents a branched alkyl group; $R^2$ to $R^4$ each represent a hydrogen atom, a hydroxyl group, an alkyl group or an aryl group; $R^5$ represents a branched alkyl group or an aryl group. The sum total of the atomic weight of the atoms constituting $R^1$ to $R^5$ is from 117 to 400. The hindered phenol compound (1) includes a constitution where $R^2$ to $R^4$ are the same or different, and a constitution where at least two of $R^2$ to $R^4$ bond to each other to form a ring along with the carbon atoms bonding to $R^2$ to $R^4$.

According to the invention, the sublimable antioxidant is a hindered phenol compound of the formula (1). The heating temperature at which the coating liquid is dried in the first drying step and the second drying step is so defined as to fall within a suitable temperature range in which, for example, the solvent in the first coating film and in the second coating film can be efficiently removed and which is lower than the boiling point of the solvent used in the coating liquid and is not higher than the heat-resistant temperature of the photoconductive substance. The hindered phenol compound of the formula (1) has the property of subliming at around such a suitable temperature, and therefore, it is possible to make the first photosensitive layer and the second photosensitive layer differ in point of the content of the antioxidant therein while the heating temperature in the first drying step and in the second drying step is made to fall within a suitable range. When the antioxidant of the type is used, then the heating temperature in the first drying step and in the second drying step may be made to fall within a suitable temperature range, and therefore the solvent may be prevented from remaining in the first coating film and in the second coating film and the photoconductive substance therein may be prevented from being degraded with the result that an electrophotographic photoreceptor having further better electric properties can be produced.

In the invention, it is preferable that the hindered phenol compound of the formula (1) is a hindered phenol compound of the following structural formula (1aa).

(1aa)

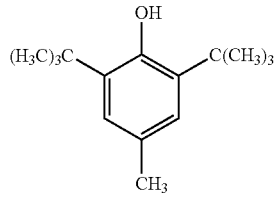

According to the invention, the hindered phenol compound of the formula (1) is a hindered phenol compound having the structural formula (1aa). Of the hindered phenol compounds of the formula (1), the hindered phenol compound of the structural formula (1aa) is a low-molecular-weight compound having a low sublimation temperature, and it sublimes at a temperature nearer to the suitable heating temperature. Therefore, when the compound is used, then it is easy to make the first photosensitive layer and the second photosensitive layer differ in point of the content of the antioxidant therein while the first coating film and the second coating film may be favorably dried.

In the invention, it is preferable that the drying condition includes a heating temperature and a heating time in the first drying step and the second drying step.

According to the invention, the drying condition includes a heating temperature and a heating time in the first drying step and the second drying step. For example, in case where the drying condition includes the heating temperature in the first drying step and the second drying step, then the heating temperature in the second drying step is made lower than the heating temperature in the first drying step, whereby the degree of sublimation of the antioxidant in the second drying step may be made lower than the degree of sublimation of the antioxidant in the first drying step. In case where the drying condition includes the heating time in the first drying step and the second drying step, then the heating time in the second drying step is made longer than the heating time in the first drying step whereby the degree of sublimation of the antioxidant in the second drying step may be made lower than the degree of sublimation of the antioxidant in the first drying step. In that manner, when the heating temperature and the heating time are varied, then it is possible to make the first photosensitive layer and the second photosensitive layer differ in point of the content of the antioxidant therein when one and the same coating liquid is used for the layers.

In the invention, it is preferable that in the first drying step, the first coating film is dried by heating at a heating temperature higher than 120° C. under normal pressure, in the second drying step, the second coating film is dried by heating at a heating temperature not higher than 120° C. under normal pressure.

According to the invention, in the first drying step, the first coating film is dried by heating it at a heating temperature higher than 120° C., and in the second drying step, the second coating film is dried by heating it at a heating temperature not higher than 120° C. For example, when a hindered phenol compound of the formula (1) is used as the antioxidant, then the heating temperature in the first drying step may be set at a temperature higher than 120° C. near to the sublimation temperature (120 to 140° C.) of the antioxidant under normal pressure ($1.013\times10^5$ Pa) to thereby increase the degree of sublimation of the antioxidant and to lower the content of the antioxidant in the first photosensitive layer. The heating temperature in the second drying step may be set not higher than 120° C. to thereby lower the degree of sublimation of the antioxidant therein than the degree of sublimation of the antioxidant in the first drying step and to increase the content of the antioxidant in the second photosensitive layer.

The invention provides an electrophotographic photoreceptor produced according to any one of the methods for producing the electrophotographic photoreceptor mentioned above.

According to the invention, the photosensitive layer is resistant to an oxidizing gas, and the electrophotographic photoreceptor has good characteristic stability and has good electric properties. Accordingly, the electrophotographic photoreceptor of the type has excellent photosensitivity and photo-responsiveness, and when used repeatedly, it is free from problems of charge potential reduction, residual potential increase and fatigue degradation.

The invention provides an image forming apparatus comprising:

the electrophotographic photoreceptor mentioned above;

a charging unit for charging the electrophotographic photoreceptor;

an exposure unit for exposing the charged electrophotographic photoreceptor to light to thereby form an electrostatic latent image thereon;

a developing unit for developing the electrostatic latent image formed on the electrophotographic photoreceptor, with a developer that contains a toner to thereby form a toner image; and a transfer unit for transferring the toner image onto a recording medium to thereby form an image on the recording medium.

According to the invention, an image forming apparatus comprises the electrophotographic photoreceptor mentioned above, a charging unit for charging the electrophotographic photoreceptor, an exposure unit for exposing the charged electrophotographic photoreceptor to light to thereby form an electrostatic latent image thereon, a developing unit for developing the electrostatic latent image formed on the electrophotographic photoreceptor, with a developer containing a toner to thereby form a toner image, and a transfer unit for transferring the toner image onto a recording medium to thereby form an image on the recording medium. In the image forming apparatus of the type, the electrophotographic photoreceptor has good photosensitivity and photo-responsiveness, and even when repeatedly used, its photosensitivity and photo-responsiveness does not lower, and therefore, using the apparatus, it is possible to form good images with no image failures of white skipping and black stripes over a prolonged period of time.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
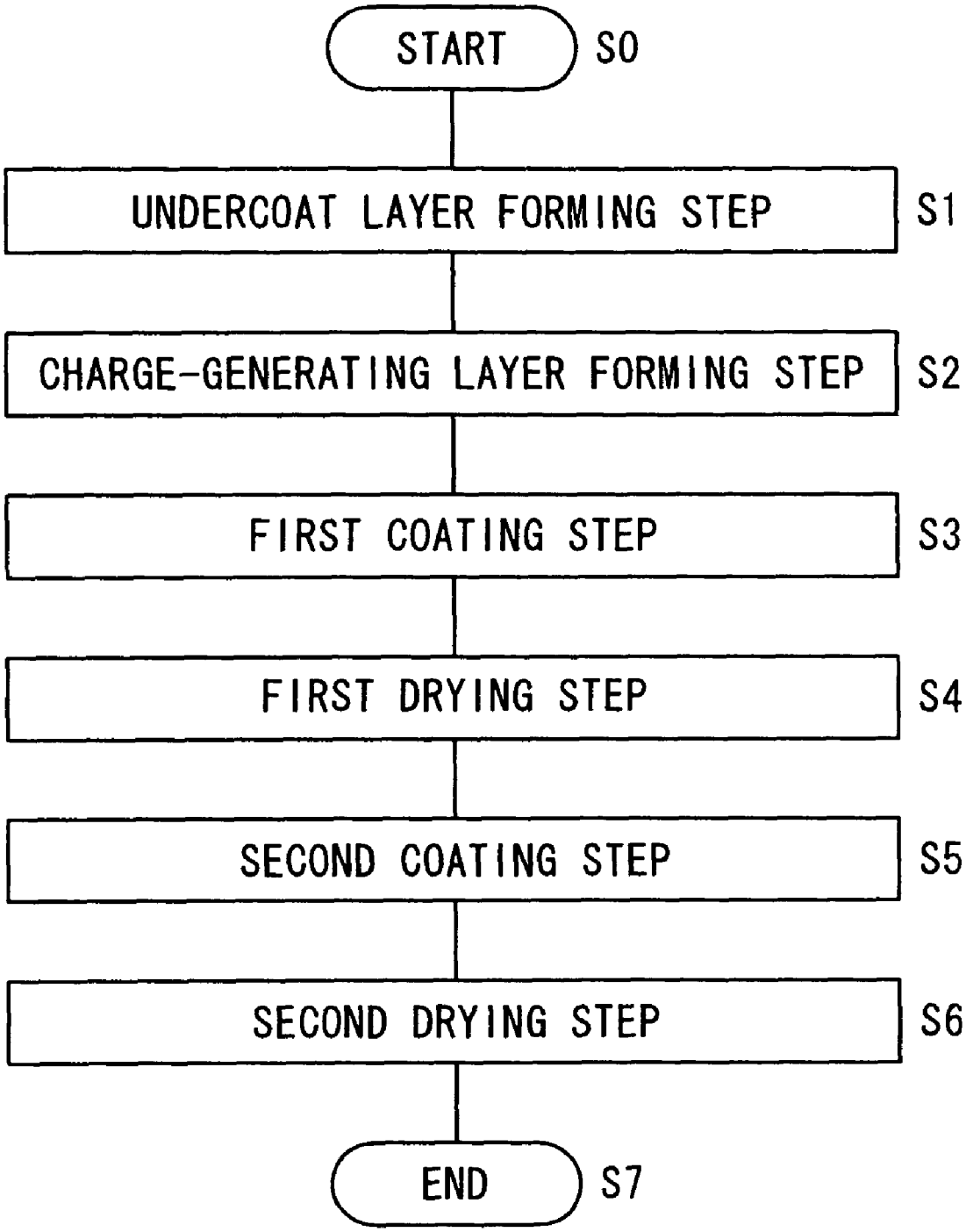
FIG. 1 is a flowchart showing a process for producing an electrophotographic photoreceptor according to a first embodiment of the invention.

Now referring to the drawings, preferred embodiments of the invention are described below.

Figure 2:
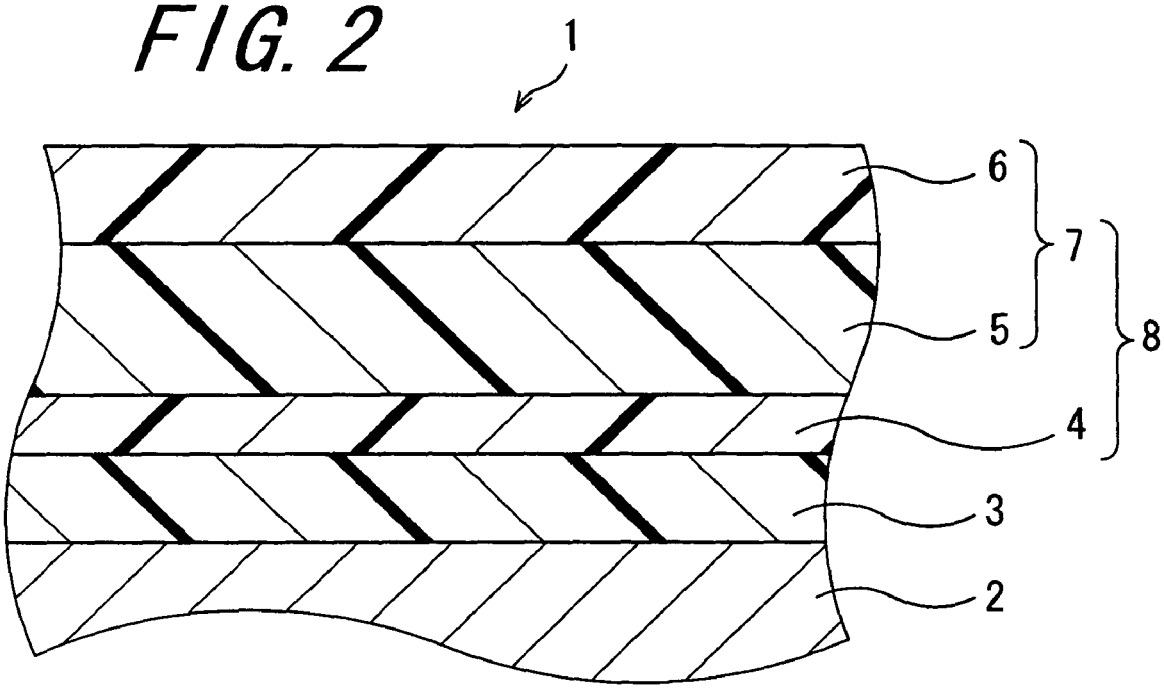
FIG. 2 is a partial cross-sectional view showing, in a simplified manner, the constitution of an electrophotographic photoreceptor that is produced according to the production method for electrophotographic photoreceptor of the first embodiment shown by the flowchart of FIG. 1.

FIG. 1 is a flowchart showing a process for producing an electrophotographic photoreceptor according to a first embodiment of the invention; FIG. 2 is a partial cross-sectional view showing, in a simplified manner, the constitution of an electrophotographic photoreceptor 1 that is produced according to the production method for electrophotographic photoreceptor of the first embodiment shown by the flowchart of FIG. 1. The production method for the electrophotographic photoreceptor (hereinafter this may be simply referred to as photoreceptor) 1 of this embodiment is a production method for the photoreceptor 1 having at least a first charge-transporting layer 5 as the first photosensitive layer and a second charge-transporting layer 6 as the second photosensitive layer, as laminated in that order on a conductive substrate 2, which comprises a first coating step of applying a coating liquid that contains a charge-transporting substance, a type of a photoconductive substance, and a sublimable antioxidant, onto a conductive substrate 2 to thereby form a first coating film thereon, a first drying step of drying the formed first coating film by heating it to thereby form a first charge-transporting layer 5, a second coating step of applying the coating liquid used in the first coating step, onto the first photosensitive layer to thereby form a second coating film, and a second drying step of drying the formed second coating film by heating it to thereby form a second charge-transporting layer 6, and wherein, in the second drying step, the drying condition for the second coating film is made to differ from the drying condition for the first coating film in the first drying step so that the degree of sublimation of the antioxidant in the second drying step may be lower than the degree of sublimation of the antioxidant in the first drying step.

The photoreceptor 1 produced according to the production method for photoreceptor of this embodiment comprises a conductive substrate 2, an undercoat layer, 3, a charge-generating layer 4, a first charge-transporting layer 5 and a second charge-transporting layer 6 as laminated in that order. The first charge-transporting layer 5 and the second charge-transporting layer 6 constitute a charge-transporting layer 7. The charge-transporting layer 7 and the charge-generating layer 4 constitute a photosensitive layer 8. The production method for producing the photoreceptor 1 of this embodiment is described below.

The production method for photoreceptor of this embodiment includes an undercoat layer-forming step of applying a coating liquid for undercoat layer formation onto the conductive substrate 2 to thereby form an undercoat layer 3 thereon, a charge-generating layer-forming step of applying a coating liquid for charge-generating layer formation onto the undercoat layer 3 to thereby form a charge-generating layer 4 thereon, and the above-mentioned, first coating step, first drying step, second coating step and second drying step.

The conductive substrate 2 has a cylindrical form in this embodiment. The conductive substrate 2 may be formed of (a) a metal material of aluminium, stainless steel, copper or nickel, or (b) a laminate material prepared by forming a layer of a conductive material such as aluminium, copper, palladium, tin oxide or indium oxide on the surface of an insulating substance such as a polyester film, a phenolic resin pipe or a paper pipe. The metal material and the conductive material are preferably conductive materials, having a volume resistivity of at most $10^{10}$ Ω·cm. The conductive substrate 2 may be oxidized on its surface for the purpose of controlling its volume resistivity to fall within the above range.

The conductive substrate 2 is an earthing conductive member for earthing the photoreceptor and additionally functions as a supporting member for the other layers 3, 4, 5, 6. The shape of the conductive substrate 2 is cylindrical in this embodiment, but not limited thereto, for example, it may also be have any other form of column, plate, sheet, film or belt.

In the undercoat layer-forming step s1, a coating liquid for undercoat layer formation is applied onto the outer peripheral surface of the cylindrical conductive substrate 2 to thereby form an undercoat layer 3 on the surface of the conductive substrate 2. The undercoat layer 3 serves as an adhesive layer for the conductive substrate 2 and the photosensitive layer 8, and additionally serves as a barrier layer for preventing charge flow from the conductive substrate 2 to the photosensitive layer 8. Accordingly, providing the undercoat layer 3 makes it possible to prevent the charge flow from the conductive substrate 2 to the photosensitive layer 8 and to keep the charge characteristic of the photoreceptor 1, thereby prolonging the life of the photoreceptor 1.

The undercoat layer 3 may be formed of, for example, a resin material such as polyamide, polyurethane, cellulose, nitrocellulose, polyvinyl alcohol, polyvinylpyrrolidone, polyacrylamide; a natural polymer material such as gelatin, starch, casein; or N-methoxymethylated nylon. When the conductive substrate 2 is formed of aluminium, or when it is formed of an insulating substance coated with an aluminium layer on its surface, then an anodic oxidation film of aluminium may be formed as the undercoat layer 3. In case where such an anodic oxidation film of aluminium is formed as the undercoat layer 3, a step of anodic oxidation film formation is attained in place of the step of applying a coating liquid for undercoat layer formation onto the outer peripheral surface of the conductive substrate 2, which will be mentioned hereinunder.

The undercoat layer 3 may contain particles of a metal oxide. The particles in the layer make it possible to control the volume resistivity of the undercoat layer 3 and to prevent the charge flow from the conductive substrate 2 to the photosensitive layer 8, further acting to keep the electric properties of the photoreceptor 1 irrespective of the ambient temperature and humidity change. The metal oxide particles include, for example, particles of titanium oxide, aluminium oxide, tin oxide.

The coating liquid for forming the undercoat layer 3 may be prepared by dispersing a material such as the above-mentioned resin and optionally metal oxide particles in a solvent. The solvent for the resin liquid may be a single solvent of, for example, alcohols such as methanol, ethanol or butanol, or water, or may be a mixed solvent or water and alcohols, or two or more different types of alcohols, or a mixed solvent of alcohols with ketones such as acetone, or ethers such as dioxolan, or a mixed solvent of alcohols with chlorine solvents such as dichloroethane, chloroform, trichloroethane. Of those, preferred is using non-chlorine solvents.

For dispersing the resin material and the optional metal oxide particles that are optionally used for volume resistivity control, in a solvent, employable is a method of using a ball mill, a sand mill, an attritor, a shaking mill, or an ultrasonic disperser.

The ratio of the overall weight of the resin material and the metal oxide to the weight of the solvent in the coating liquid for undercoat layer formation (total weight of resin material and metal oxide/weight of solvent) may be determined depending on the thickness of the undercoat layer to be formed, but is preferably from 1/99 to 40/60 (that is, from 0.01 to 0.67), more preferably from 2/98 to 30/70 (that is, from 0.02 to 0.43). When the ratio of the total weight of the resin material and the metal oxide to the weight of the solvent is less than 1/99, then the weight of the solvent may be too large and drying the solvent may take a lot of time, and, in addition, the coating operation may be effected plural times for forming the undercoat layer having a desired thickness. When the ratio of the total weight of the resin material and the metal oxide to the weight of the solvent is more than 40/60, then the viscosity of the undercoat layer-forming coating liquid may be too high and the thickness of the undercoat layer formed may be uneven.

In case where the undercoat layer 3 is made to contain a metal oxide, then the ratio of the content of the metal oxide to the content of the resin material (content of metal oxide/content of resin material) is preferably from 1/99 to 90/10 (that is, from 0.01 to 9.0), more preferably from 5/95 to 70/30 (that is, from 0.05 to 2.33). When the ratio of the content of the metal oxide to the content of the resin material is less than 1/99, then the metal oxide could not exhibit its effect of volume resistivity control; but when it is more than 90/10, then the volume resistivity of the undercoat layer may be too low, thereby resulting in the problem of charge flow from the conductive substrate 2 to the photosensitive layer 8.

For applying the coating liquid for undercoat layer formation onto the conductive substrate 2, herein employable is a spraying method, a vertical ring method or a dipping method when the conductive substrate 2 is cylindrical as in this embodiment, or is columnar. On the other hand, when the conductive substrate 2 on which the undercoat layer 3 is formed has a form of plate, sheet or film, then the coating liquid may be applied thereto using a baker's applicator, a bar coater, a caster or a spin coater. After the coating liquid for undercoat layer formation has been applied to the conductive substrate 2, the coating liquid is dried and the solvent in the coating liquid is removed. Drying the coating liquid for undercoat layer formation, as applied onto the conductive substrate 2, may be attained by heating, like the case of forming the first charge-transporting layer 5 or the second charge-transporting layer 6 that will be mentioned hereinunder, but may be attained merely by leaving the coated substrate at room temperature without specifically heating it.

The undercoat layer 3 preferably has a thickness of from 0.1 μm to 10 μm, after dried. When the dry thickness of the undercoat layer 3 is less than 0.1 μm, then the undercoat layer 3 could not sufficiently exhibit its effect and the charge flow from the conductive substrate 2 to the photosensitive layer 8 may occur to lower the chargeability of the photoreceptor 1.

When the thickness of the undercoat layer 3 is more than 10 μm, then the photosensitivity of the photoreceptor 1 may lower.

After the undercoat layer 3 has been formed on the conductive substrate 2, then a charge-generating layer-forming step s2 is effected, which is to form a charge-generating layer 4 on the surface of the undercoat layer 3, or that is, on the side of the undercoat layer 3 opposite to the conductive substrate 2. In the charge-generating layer-forming step s2, a coating liquid for charge-generating layer formation is applied onto the surface of the undercoat layer 3 formed on the conductive substrate 2, thereby forming a charge-generating layer 4 on the undercoat layer 3.

The charge-generating layer 4 contains a charge-generating substance. The charge-generating substance is a substance capable of absorbing light to generate a free charge. The material that constitutes such a substance capable of absorbing light to generate a free charge includes, for example, inorganic pigments, organic pigments, organic dyes. The inorganic pigments include inorganic photoconductive substances such as selenium and its alloys, arsenic-selenium, cadmium sulfide, zinc oxide, amorphous silicon. The organic pigments include phthalocyanine compounds, azo compounds, quinacridone compounds, polycyclic quinone compounds, perylene compounds. The organic dyes include thiapyrylium salts, squarylium salts. Of the above-mentioned charge-generating substances, preferred are organic photoconductive substances such as organic pigments and organic dyes. Of organic photoconductive substances, more preferred for use herein are phthalocyanine compounds, and most preferred are titanylphthalocyanine compounds of the following general formula (2). Using a titanylphthalocyanine compound of the formula (2) improves the photosensitivity and the chargeability of the photoreceptor 1 and realizes the photoreceptor 1 having excellent image reproducibility.

(2)

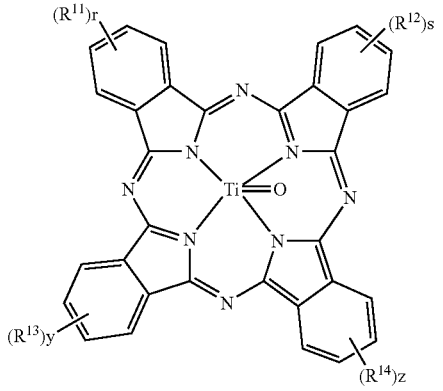

In the formula (2), $R^{11}$, $R^{12}$, $R^{13}$ and $R^{14}$ each represent a hydrogen atom, a halogen atom, an alkyl group or an alkoxy group. r, s, y and z each indicate an integer of from 1 to 4. The halogen atom for $R^{11}$, $R^{12}$, $R^{13}$ and $R^{14}$ includes a fluorine atom, a chlorine atom, a bromine atom. Of those, preferred are a fluorine atom and a chlorine atom. The alkyl group includes a linear alkyl group such as a methyl group, an ethyl group, an n-propyl group, an n-butyl group; and a branched alkyl group such as an isopropyl group, a t-butyl group. Of those, preferred are an alkyl group having from 1 to 4 carbon atoms. The alkoxy group includes a linear alkoxy group such as a methoxy group, an ethoxy group, an n-propoxy group; and a branched alkoxy group such as an isopropoxy group. Of those, preferred is an alkoxy group having from 1 to 4 carbon atoms.

The titanylphthalocyanine compounds of the formula (2) may be produced, for example, according to the method described in Moser & Thomas' *Phthalocyanine Compounds,* for example, according to the following production method. For example, of the titanylphthalocyanine compounds of the formula (2), titanylphthalocyanine where $R^{11}$, $R^{12}$, $R^{13}$ and $R^{14}$ are all hydrogen atoms may be produced by melting phthalonitrile and titanium tetrachloride under heat, or reacting them in a suitable solvent such as α-chloronaphthalene under heat to give dichlorotitanium phthalocyanine, and hydrolyzing it with a base or water. Apart from this, titanylphthalocyanine may also be produced by reacting isoindoline with a titanium tetraalkoxide such as titanium tetrabutoxide under heat in a suitable solvent such as N-methylpyrrolidone.

The charge-generating layer 4 may contain, in addition to above-mentioned charge-generating substance, sensitizer such as chemical sensitizer or optical sensitizer. For the chemical sensitizer, usable is an electron-accepting substance, for example, a cyano compound such as tetracyanoethylene, 7,7,8,8-tetracyanoquinodimethane; a quinone compound such as anthraquinone, p-benzoquinone; or a nitro compound such as 2,4,7-trinitrofluorenone, 2,4,5,7-tetranitrofluorenone. The optical sensitizer includes xanthene dye, thiazine dye, triphenylmethane dye.

The coating liquid for forming the charge-generating layer 4 may be prepared by dispersing the above-mentioned charge-generating substance in a suitable solvent followed by adding a binding agent, or that is, a binder resin thereto. In case where the above-mentioned sensitizer is added to it, the sensitizer may also be dispersed in the solvent. Prior to being dispersed in the solvent, the charge-generating substance may be previously ground with a grinder. The grinder includes a ball mill, a sand grinder, a paint shaker, an ultrasonic disperser.

The binder resin to be added to the coating liquid forming the charge-generating layer 4 may be a material having a binding capability. The binder resin includes, for example, polyarylate, polyvinylbutyral, polycarbonate, polyester, polystyrene, polyvinyl chloride, phenoxy resin, epoxy resin, silicone resin, polyacrylate.

Preferably, the charge-generating substance is in the charge-generating layer 4 in an amount of from 10% by weight to 99% by weight of the overall weight of the layer. When the content of the charge-generating substance is less than 10% by weight, then the photosensitivity of the photoreceptor 1 may lower. When the content of the charge-generating substance is more than 99% by weight, then the content of the binder resin in the charge-generating layer 4 may lower with the result that not only the mechanical strength of the layer may lower but also the dispersibility of the charge-generating substance in the binder resin may lower to form coarse particles and, in such a case, the surface charges not in the area in which the surface charges are to be reduced may decrease through exposure to light, therefore resulting in that image failures especially image fogging or, that is, black peppers to be formed by toner adhesion to a white background area may much increase.

The solvent to be used in the coating liquid for forming the charge-generating layer 4 includes, for example, alcohols such as isopropyl alcohol; ketones such as cyclohexanone, acetone, methyl ethyl ketone; aliphatic hydrocarbons such as cyclohexane; aromatic hydrocarbons such as toluene, xylene; ethers such as tetrahydrofuran, dioxane, dioxolan; ethylene glycol alkyl ethers such as ethyl cellosolve, ethylene glycol dimethyl ether, 1,2-dimethoxyethane; esters such as ethyl acetate, methyl acetate; halogenohydrocarbons such as dichloromethane, dichloroethane, monochlorobenzene; amides such as N,N-dimethylformamide, N,N-dimethylacetamide. One or more such solvents may be used herein either singly or as combined.

When an inorganic pigment or an organic pigment that may easily undergo crystal transition is used as the charge-generating substance, then the solvent for it is preferably any of cyclohexane, 1,2-dimethoxyethane, methyl ethyl ketone or tetrahydrofuran, or their mixed solvent, for the purpose of preventing the photosensitivity depression owing to the crystal transition to occur during grinding and milling the charge-generating substance, or for the purpose of preventing the characteristic degradation owing to the pot life.

The ratio of the total weight of the charge-generating substance and the binder resin to the weight of the solvent in the coating liquid for charge-generating layer formation (total weight of charge-generating substance and binder resin/weight of solvent) is preferably from 1/99 to 40/60 (that is, from 0.01 to 0.67), more preferably from 2/98 to 30/70 (that is, from 0.02 to 0.43). When the ratio of the total weight of the charge-generating substance and the binder resin to the weight of the solvent is less than 1/99, then the weight of the solvent may be too large and drying the solvent may take a lot of time. When the ratio of the total weight of the charge-generating substance and the binder resin to the weight of the solvent is more than 40/60, then the viscosity of the charge-generating layer-forming coating liquid may be too high and the thickness of the charge-generating layer formed may be uneven.

Applying the coating liquid for forming the charge-generating layer 4 on the surface of the undercoat layer 3 may be attained in the same manner as that for applying the above-mentioned coating liquid for forming the undercoat layer 3 on the conductive substrate 2.

Preferably, the thickness of the charge-generating layer 4 is from 0.05 μm to 5 μm, more preferably from 0.1 μm to 1 μm, after dried. When the thickness of the charge-generating layer 4 is less than 0.05 μm, then the light absorbability of the layer may lower and the photosensitivity of the photoreceptor 1 may lower. When the thickness of the charge-generating layer 4 is more than 5 μm, then the charge movement inside the charge-generating layer 4 may be the rate-limiting step in the process of reducing the surface charges of the photosensitive layer 8 and the photosensitivity of the photoreceptor 1 may thereby lower.

After the charge-generating layer 4 has been formed on the undercoat layer 3, then a first coating step (s3) and a first drying step (s4) for forming a first charge-transporting layer 5 on the charge-generating layer 4, and a second coating step (s5) and a second drying step (s6) for forming a second charge-transporting layer 6 on the first charge-transporting layer 5 are attained. The charge-transporting layer 7 that comprises the first charge-transporting layer 5 and the second charge-transporting layer 6 is constituted to contain a charge-transporting substance that has the ability to accept the charges which the charge-generating substance in the charge-generating layer 4 has generated and to transport them, and a binder resin to bind the charge-transporting substance.

In the production method for photoreceptor of this embodiment, the same coating liquid is used for forming the first charge-transporting layer 5 and the second charge-transporting layer 6.

Not specifically defined, the charge-transporting substance to be in the charge-transporting layer 7 may be any one that has the ability to accept the charges which the charge-generating substance in the charge-generating layer 4 has generated and to transport them. The charge-transporting substance includes electron-donating substances such as poly-N-vinylcarbazole and its derivatives, poly-g-carbazolylethyl glutamate and its derivatives, polyvinylpyrene, polyvinylphenanthrene, oxazole derivatives, oxadiazole derivatives, imidazole derivatives, 9-(p-diethylaminostyryl)anthracene, 1,1-bis(4-benzylaminophenyl)propane, styrylanthracene, styrylpyrazoline, pyrazoline derivatives, phenylhydrazones, hydrazone derivatives, triphenylamine compounds, tetraphenyldiamine compounds, stilbene compounds, 3-methyl-2-benzothiazoline ring-having azine compounds, enamine compounds, butadiene compounds.

The charge-transporting layer 7 of the photoreceptor 1 produced according to the production method of the invention contains a sublimable antioxidant. The sublimable antioxidant preferably has a sublimation temperature under normal pressure (one atmosphere; $1.013\times10^5$ Pa) of from 120° C. to 140° C. In the first drying step of drying the first coating film formed in the first coating step and the second drying step of drying the second coating film formed in the second coating step, the coated substrate is heated at a suitable temperature depending on the type of the solvent in the coating liquid and on the heat-resistant temperature of the charge-transporting substance or the charge-generating substance that is a photoconductive substance. The suitable temperature in the first drying step and in the second drying step is described hereinunder.

When the sublimation temperature of the sublimable antioxidant is from 120° C. to 140° C., then the sublimable antioxidant may sublime under heat at a suitable temperature in photoreceptor production, and therefore, the content of the sublimable antioxidant in the first charge-transporting layer 5 may be made to differ from the content of the sublimable antioxidant in the second charge-transporting layer 6 in the first drying step and the second drying step that are mentioned hereinunder. The content of the sublimable antioxidant in the first charge-transporting layer 5 as referred to herein means the ratio of the weight of the sublimable antioxidant to the weight of the photoconductive substance, or that is, the charge-transporting substance in this embodiment, in the first charge-transporting layer 5. The content of the sublimable antioxidant in the second charge-transporting layer 6 means the ratio of the weight of the sublimable antioxidant to the weight of the photoconductive substance, or that is, the charge-transporting substance in this embodiment, in the second charge-transporting layer 6.

For the sublimable antioxidant, for example, usable is a hindered phenol compound of the following general formula (1) (hereinafter this may be referred to as hindered phenol compound (1)). The hindered phenol compound (1) is a compound having, in the molecule thereof, a hindered phenol structural unit, or that is, a phenolic structural unit characterized by the presence of a bulky substituent at the position adjacent to the phenolic hydroxyl group therein, as shown by the following general formula (1):

(1)

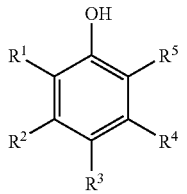

In the formula (1), $R^1$ represents a branched alkyl group; $R^2$ to $R^4$ each represent a hydrogen atom, a hydroxyl group, an alkyl group or an aryl group; $R^5$ represents a branched alkyl group or an aryl group. The sum total of the atomic weight of the atoms constituting $R^1$ to $R^5$ is from 117 to 400. The hindered phenol compound (1) includes a constitution where $R^2$ to $R^4$ are the same or different, and a constitution where at least two of $R^2$ to $R^4$ bond to each other to form a ring along with the carbon atoms bonding to $R^2$ to $R^4$.

When the sum total of the atomic weight of the atoms constituting $R^1$ to $R^5$ in the hindered phenol compound (1) is more than 400, then the sublimation temperature of the hindered phenol compound may be high and the hindered phenol compound could not sublime at the suitable temperature in the first drying step and the second drying step. In case where the hindered phenol compound could not sublime, then it may be impossible to make the first charge-transporting layer 5 differ from the second charge-transporting layer 6 in point of the content of the sublimable antioxidant in the layers. When the sum total of the atomic weight of the atoms constituting $R^1$ to $R^5$ in the hindered phenol compound (1) is less than 117, then it may fail to constitute the hindered phenol compound.

In the formula (1), the branched alkyl group represented by $R^1$ includes a t-alkyl group such as a t-butyl group, a t-pentyl group, a t-octyl group; and an s-alkyl group such as an s-butyl group, an s-octyl group, an s-octadecyl group. Of those, especially preferred is a t-butyl group which is a bulky substituent having a small molecular weight.

In the formula (1), the alkyl group represented by $R^2$, $R^3$ and $R^4$ includes a linear alkyl group such as a methyl group, an ethyl group, a hexyl group, an octyl group; and a branched alkyl groups such as a t-butyl group, a t-pentyl group. The aryl group represented by $R^2$, $R^3$ and $R^4$ includes a phenyl group, a naphthyl group, an anthryl group, a biphenylyl group.

In the formula (1), the branched alkyl group represented by $R^5$ includes a t-alkyl group such as a t-butyl group, a t-pentyl group, a t-octyl group; and an s-alkyl group such as an s-butyl group, an s-octyl group, an s-octadecyl group. The aryl group represented by $R^5$ includes a phenyl group, a naphthyl group, an anthryl group, a biphenylyl group. Of the alkyl group and the aryl group, $R^5$ is preferably a bulky substituent having a small number of carbon atoms. Especially preferably, an electron-donating substituent is disposed for $R^5$ in order that the phenolic hydroxyl group may have a high electron density. Even more preferably, $R^5$ is a t-butyl group which is an electron-donating bulky substituent having a small number of carbon atoms.

These alkyl group and aryl group may have a substituent. The substituent includes, for example, an ester group, a carboxylic acid group, a phosphoric acid group, a thioether group.

Of the hindered phenol compounds (1), more preferred are those of the following structural formula (1a), provided that $R^{3a}$ represents an alkyl group or an aryl group.

(1a)

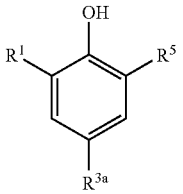

Examples of the hindered phenol compounds (1) are, for example, hindered phenol compounds of the following structural formulae (1aa) to (1ac), to which, however, the invention should not be limited.

(1aa)

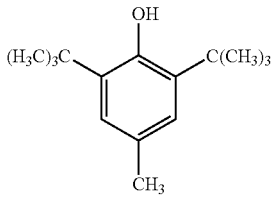

(1ab)

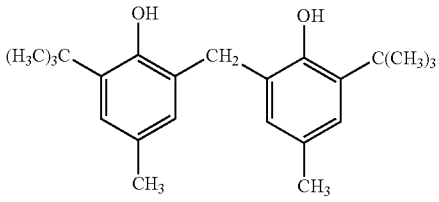

(1ac)

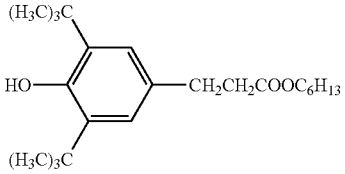

In the hindered phenol compound of the structural formula (1aa), the sum total of the atomic weight of the atoms constituting $R^1$ to $R^5$ in the formula (1) is 131. In the hindered phenol compound of the structural formula (1ab), the sum total of the atomic weight of the atoms constituting $R^1$ to $R^5$ in the formula (1) is 251. In the hindered phenol compound of the structural formula (1ac), the sum total of the atomic weight of the atoms constituting $R^1$ to $R^5$ in the formula (1) is 273. For the hindered phenol compound of the formula (1), one or more selected from the group of the structural formulae (1aa) to (1ac) may be used herein either singly or as combined.

Of the hindered phenol compound (1), most preferred for use herein is the hindered phenol compound of the structural formula (1aa). The hindered phenol compound of the structural formula (1aa) is a low-molecular compound having a lowermost sublimation temperature of the hindered phenol compound (1), and sublimes at a temperature nearer to the suitable heating temperature. When the hindered phenol compound of the structural formula (1aa) is used, then the first coating film and the second coating film may be well dried and the first photosensitive layer may be readily made to differ from the second photosensitive layer in point of the content of the sublimable antioxidant in the layers.

The coating liquid for forming the charge-transporting layer that contains such a sublimable antioxidant and a charge-transporting substance contains at least a solvent capable of dispersing the sublimable antioxidant and the charge-transporting substance, and a binding agent, or that is, a binder resin.

The binder resin may be any one miscible with the charge-transporting substance, for example, including polycarbonate, copolycarbonate, polyarylate, polyvinyl butyral, polyamide, polyester, epoxy resin, polyurethane, polyketone, polyvinyl ketone, polystyrene, polyacrylamide, phenolic resin, phenoxy resin and polysulfone resin, as well as copolymer resin that contains at least two repetitive units constituting them. One or more these resins may be used herein either singly or as combined. Of the above-mentioned binder resins, preferred are polystyrene, polycarbonate, copolycarbonate, polyarylate and polyester as they have a volume resistivity of at least $10^{13}$ Ω·cm and have an excellent electric insulating capability and its film-forming capability and potential characteristics are also excellent.

The charge-transporting layer may be made to contain one or more electron-accepting substances to thereby improve the photosensitivity of the photoreceptor 1 and to inhibit the increase in the residual potential of the layer and the fatigue thereof in repeated use. The electron-accepting substance includes, for example, acid anhydrides such as succinic anhydride, maleic anhydride, phthalic anhydride, 4-chloronaphthalic anhydride, cyano compounds such as tetracyanoethylene, terephthalmalondinitrile; aldehydes such as 4-nitrobenzaldehyde; anthraquinones such as anthraquinone, 1-nitroanthraquinone; polycyclic or heterocyclic nitro compounds such as 2,4,7-trinitrofluorenone, 2,4,5,7-tetranitrofluorenone. These may be used as a chemical sensitizer.

The solvent to be in the coating liquid for forming the charge-transporting layer includes, for example, alcohols such as methanol, ethanol; ketones such as acetone, methyl ethyl ketone, cyclohexanone; ethers such as ethyl ether, tetrahydrofuran, dioxane, dioxolan; aliphatic halogenohydrocarbons such as chloroform, dichloromethane, dichloroethane; aromatic hydrocarbons such as benzene, chlorobenzene, toluene. One or more these solvents may be used either singly or as combined.

For dispersing the solid matter such as the charge-transporting substance, the sublimable antioxidant, the binder resin and the electron-accepting substance in a solvent, employable is a method of using a ball mill, a sand mill, an attritor, a shaking mill, or an ultrasonic disperser.

The ratio of the weight of the solid matter, or that is, the total weight of the charge-transporting substance, the sublimable antioxidant, the binder resin and the electron-accepting substance to the weight of the solvent in the coating liquid (weight of the solid matter/weight of the solvent) may be determined depending on the thickness of the first charge-transporting layer 5 and the second charge-transporting layer 6 to be formed, but is preferably from 1/99 to 40/60 (that is, from 0.01 to 0.67), more preferably from 2/98 to 30/70 (that is, from 0.02 to 0.43). When the ratio of the weight of the solid matter to the weight of the solvent is less than 1/99, then the removal of the solvent by heating may take a lot of time, and the degree of sublimation of the sublimable antioxidant may be too high depending on the heating temperature. When the ratio of the weight of the solid matter to the weight of the solvent is more than 40/60, then the viscosity of the coating liquid may be too high to form a first charge-transporting layer 5 and a second charge-transporting layer 6 having a uniform thickness.

Preferably, the charge-transporting substance to be in the charge-transporting layer 7 is in the coating liquid in a ratio of from 30% by weight to 80% by weight to the weight of the solid matter, or that is, the total weight of the charge-transporting substance, the sublimable antioxidant, the binder resin and the electron-accepting substance to constitute the charge-transporting layer 7. When the content of the charge-transporting substance is less than 30% by weight, then the content of the binder resin in the charge-transporting layer 7 is to be low and therefore the printing durability of the layer may be low with the result that the abrasion of the charge-transporting layer 7 may increase and the durability life thereof may shorten. When the content of the charge-transporting substance is more than 80% by weight, then the content of the binder resin in the charge-transporting layer 7 is to high and therefore the viscosity of the coating liquid may increase with the result that the coating speed may lower and the producibility may greatly lower. In case where the amount of the solvent in the coating liquid is made larger than the above-mentioned preferred range for the purpose of preventing the increase in the viscosity, then there may occur a brushing phenomenon meaning that the formed charge-transporting layer is cloudy.

Preferably, the content of the sublimable antioxidant in the coating liquid to form the first charge-transporting layer 5 and the second charge-transporting layer 6 is from 5% by weight to 45% by weight of the charge-transporting layer therein, or that is, the sublimable antioxidant is in the liquid in an amount of from 5 parts by weight to 45 parts by weight relative to 100 parts by weight of the charge-transporting substance therein. The content of the sublimable antioxidant in the first charge-transporting layer 4 and the second charge-transporting layer 5 lowers through sublimation of the sublimable antioxidant in the first drying step and the second drying step that may be described hereinunder, and therefore the amount of the sublimable antioxidant in the coating liquid should be at least the amount thereof to be in the second charge-transporting layer 6 after dried.

In the first coating step s3, a coating liquid for charge-transporting layer formation that contains a photoconductive substance, or that is, a charge-transporting substance and a sublimable antioxidant is applied onto the conductive substrate 2 with the undercoat layer 3 and the charge-generating layer 4 formed thereon, to thereby form a first coating film on it. The coating operation with the coating liquid in the first coating step may be attained in the same manner as that mentioned hereinabove for applying the undercoat layer-forming coating liquid for forming the undercoat layer 3 and for applying the charge-generating layer-forming liquid for forming the charge-generating layer 4. The first coating film formed in the first coating step is dried in the first drying step to be the first charge-transporting layer 5.

In the first coating step, the coating liquid is applied, depending on the thickness of the first charge-transporting layer 5 to be formed, thereby to form the first coating film. The thickness of the first charge-transporting layer 5 to be formed will be described hereinunder along with the explanation of the second coating film to be formed in the second coating step depending on the thickness of the second charge-transporting layer 6 to be formed, which is described hereinunder.

After the first coating film has been formed in the first coating step, it is dried in the first drying step s4. In the first drying step s4, the first coating film formed in the first coating step is dried to thereby form the first charge-transporting layer 5.

In the first drying step, the first coating film is dried, using, for example, a drier with a heat source such as hot air or far-infrared rays. In the first drying step, the first coating film may also be dried by heating it according to a heating method such as a microwave heating method, a dielectric heating method, an induction heating method. The drying condition such as the heating temperature and the heating time in the first drying step may be suitably determined depending on various conditions such as the solvent used in the coating liquid and the thickness of the first charge-transporting layer 5. The drying condition for the first coating film in the first drying step will be described hereinunder along with the drying condition for the second coating film in the second drying step.

After the solvent in the first coating film has been removed by heating in the first drying step to form the first charge-transporting layer 5, then the second coating step (s5) and the second drying step (s6) are carried out to form the second charge-transporting layer 6.

In the second coating step s5, the coating liquid used in the first coating step is applied onto the first charge-transporting layer 5 formed in the second drying step, to thereby form a second coating film thereon. Applying the coating liquid in the second coating step may be attained in the same manner as that for applying the undercoat layer-forming coating liquid to form the undercoat layer 3 as described hereinabove. The second coating film formed in the second coating step is dried in the second drying step to be the second charge-transporting layer 6.

In the second coating step, the coating liquid is prepared so as to control the coating film to be formed of it, depending on the second charge-transporting layer 6 to be formed. Hereinafter a preferred thickness of the first charge-transporting layer 5 and a preferred thickness of the second charge-transporting layer 6 are described. The thickness of the charge-transporting layer 7, or that is, the total of the thickness of the first charge-transporting layer 5 and that of the second charge-transporting layer 6 in this embodiment is preferably from 10 μm to 50 μm, more preferably from 15 μm to 40 μm. When the thickness of the charge-transporting layer 7 is less than 10 μm, then the charge retainability of the surface of the photoreceptor 1 may lower. When the thickness of the charge-transporting layer 7 is more than 50 μm, then the resolution of the photoreceptor 1 may lower.

The thickness dimension of the second charge-transporting layer 6 of the charge-transporting layer 7 is determined depending on the content of the sublimable antioxidant in the first charge-transporting layer 5 and the second charge-transporting layer 6. In case where the charge-transporting layer 7 is formed of the two layers, the first charge-transporting layer 5 and the second charge-transporting layer 6 as in this embodiment, the thickness of the second charge-transporting layer 6 is preferably smaller than that of the first charge-transporting layer 5. When the second charge-transporting layer 6 is made thinner than the first charge-transporting layer 5, then the electric properties of the charge-transporting layer 7 may be prevented from worsening.

Preferably, the thickness of the second charge-transporting layer 6 is from 25% to 40% of the thickness of the charge-transporting layer 7. In other words, when the charge-transporting layer 7 is formed of the two layers, the first charge-transporting layer 5 and the second charge-transporting layer 6, then the thickness of the first charge-transporting layer 5 is preferably from 60% to 75% of the charge-transporting layer 7.

When the thickness of the second charge-transporting layer 6 is less than 25% of the charge-transporting layer 7 in case where the charge-transporting layer 7 is formed of the two layers, the first charge-transporting layer 5 and the second charge-transporting layer 6, then the resistance to oxidizing gas of the charge-transporting layer 7 could not be sufficient. When the thickness of the second charge-transporting layer 6 is more than 40%, then the proportion of the second charge-transporting layer 6 that has a high sublimable antioxidant content may be large and therefore the content of the sublimable antioxidant in the charge-transporting layer 7 is to be too high as a whole, resulting in that the electric properties of the charge-transporting layer 7 may worsen.

After the second coating film has been formed in the second coating step, it is dried in the second drying step s6. In the second drying step s6, the second coating film formed in the second coating step is dried by heating it, thereby forming the second charge-transporting layer 6.

In the second drying step, the drying condition for the second coating film is made to differ from the drying condition for the first coating film in the first drying step so that the degree of sublimation of the sublimable antioxidant in the second drying step may be lower than the degree of sublimation of the sublimable antioxidant in the first drying step. The degree of sublimation of the sublimable antioxidant means the ratio of the weight of the sublimable antioxidant sublimed to the weight of the sublimable antioxidant put in the coating liquid (weight of the sublimed sublimable antioxidant/weight of the sublimable antioxidant put in the coating liquid). When the degree of sublimation of the sublimable antioxidant is high, then the degree of the residual sublimable antioxidant, or that is, the ratio of the weight of the unsublimed sublimable antioxidant to the weight of the sublimable antioxidant put in the coating liquid may be low. A charge-transporting material is not sublimable. Accordingly, when the degree of sublimation of the sublimable antioxidant is made high, then the content of the sublimable antioxidant, or that is, the ratio of the weight of the sublimable antioxidant to the weight of the charge-transporting material may be low.

In that manner, when the degree of sublimation of the sublimable antioxidant in the first drying step is made to differ from the degree of sublimation of the sublimable antioxidant in the second drying step, then the content of the sublimable antioxidant in the first charge-transporting layer 5 may be made to differ from the content of the sublimable antioxidant in the second charge-transporting layer 6. Further, when the degree of sublimation of the sublimable antioxidant in the second drying step is made lower than the degree of sublimation of the sublimable antioxidant in the first drying step, then the content of the sublimable antioxidant in the first charge-transporting layer 5 near to the conductive substrate 2 may be made low and the content of the sublimable antioxidant in the second charge-transporting layer 6 near to the outer surface of the photoreceptor 1 may be made high.

The drying condition in the first drying step and the second drying step is, for example, the heating temperature, the heating time, and the vapor pressure in a drier. The drying condition in the second drying step is made to differ from the drying condition in the first drying step, whereby the degree of sublimation of the sublimable antioxidant in the second drying step may be made lower than the degree of sublimation of the sublimable antioxidant in the first drying step, and the method for it is described below.

First described is a method of employing different heating temperatures to thereby make the content of the sublimable antioxidant in the first charge-transporting layer 5 differ from the content of the sublimable antioxidant in the second charge-transporting layer 6. The heating temperature in the first drying step as referred to herein means the temperature of the first coating film to be heated and dried in the first drying step; and the heating temperature in the second drying step means the temperature of the second coating film to be heated and dried in the second drying step. In case where the first coating film and the second coating film are heated for a same period of time, then the heating temperature in the second drying step is made lower than the heating temperature in the first drying step in order that the degree of sublimation of the sublimable antioxidant in the second drying step may be made lower than the degree of the sublimable antioxidant in the first drying step.

In case where the heating temperature in the first drying step is made to differ from the heating step in the second drying step, then the heating temperatures in these drying steps must be within the preferred temperature ranges in these drying step, depending on various conditions of, for example, the solvent used for the coating liquid and the thickness of the first charge-transporting layer 5. More concretely, the preferred temperature ranges are determined depending on the boiling point of the solvent used in the coating liquid, the heat-resistant temperature of the photoconductive substance and the temperature of the charge-transporting substance having a low heat-resistant temperature of the photoconductive substance. When the heating temperature is much higher than the boiling point of the solvent, then the solvent may give many bubbles, thereby resulting in that the dried first charge-transporting layer 5 and second charge-transporting layer 6 may have bubbles and thickness unevenness. When the heating temperature is higher than the heat-resistant temperature of the photoconductive substance, then the electric properties of the photoreceptor 1 may worsen.

Accordingly, the heating temperature in the first drying step and the second drying step must be a temperature not lower than the boiling point of the solvent used in the coating liquid but not so much higher than the boiling point of the solvent, which additionally must be a temperature not higher than the heat-resistant temperature of the photoconductive substance. In case where the solvent and the photoconductive substance mentioned hereinabove are used, then the heating temperature in the first drying step and the second drying step is preferably from 70° C. to 180° C., more preferably from 70° C. to 140° C. When the heating temperature in the drying steps is lower than 70° C., then the heating efficiency may be poor and the coating film may be difficult to dry within a short period of time.

Further, in the first drying step, the first coating film is dried by heating it preferably at a heating temperature higher than 120° C.; and in the second drying step, the second coating film is dried by heating it preferably at a heating temperature not higher than 120° C. In case, for example, where a hindered phenol compound of the formula (1) is used as the sublimable antioxidant, the heating temperature in the first drying step may be made higher than 120° C. to thereby increase the degree of sublimation of the sublimable antioxidant and to make the content of the sublimable antioxidant in the first photosensitive layer lower than the content of the sublimable antioxidant in the coating liquid. When the heating temperature in the first drying step is made not higher than 120° C., then the sublimable antioxidant may hardly sublime and the degree of sublimation of the sublimable antioxidant may be reduced, whereby the content of the sublimable antioxidant in the second photosensitive layer may be made higher than the content of the sublimable antioxidant in the first photosensitive layer.

A concrete experimental example is shown below, in which a hindered phenol compound (1) is used as one example of the sublimable antioxidant, and this hardly sublimes at a heating temperature not higher than 120° C. and the degree of sublimation of the sublimable antioxidant is thereby reduced. The photoreceptor used in the experimental example was prepared as follows: An undercoat layer and a charge-generating layer were laminated in that order on the outer peripheral surface of a cylindrical conductive substrate, and a coating liquid for charge-transporting layer formation that contains the sublimable antioxidant was applied onto the surface of the charge-generating layer, and heated at a heating temperature of 120° C. to thereby dry the coating film to form a charge-transporting layer thereon. The constitution of the conductive substrate, that of the undercoat layer and that of the charge-generating layer were the same as those described in Example 1 to be mentioned below, and their description is omitted herein.

The coating liquid for charge-transporting layer formation is described. 100 parts by weight of a charge-transporting substance of a butadiene compound of the following structural formula (3), T405 (trade name by Takasago Chemical), 200 parts by weight of a binder resin, TS2020 (trade name by Teijin Chemical), and 30 parts by weight of a sublimable antioxidant of a hindered phenol compound were dispersed in 980 parts by weight of tetrahydrofuran to prepare a coating liquid for charge-transporting layer formation. The hindered phenol compound is the compound of the structural formula (1aa), and a coating liquid A for charge-transporting layer formation was thus prepared.

(3)

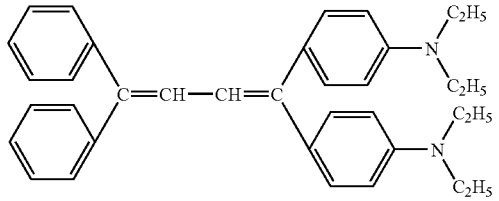

In the same manner as that for the coating liquid A, a coating liquid B for charge-transporting layer formation was prepared, for which, however, the hindered phenol compound of the structural formula (1ac) was used in place of the hindered phenol compound of the structural formula (1aa).

In the same manner as that for the coating liquid A, a coating liquid C for charge-transporting layer formation was prepared, for which, however, a hindered phenol compound of the following structural formula (4) was used in place of the hindered phenol compound of the structural formula (1aa).

(4)

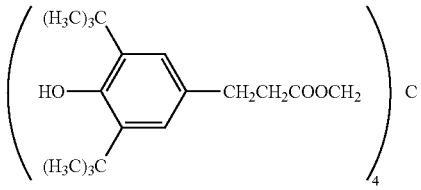

The coating liquid A was applied to the conductive substrate having the charge-generating layer and the undercoat layer formed thereon and having a Cu—Ni alloy T-thermocouple (by Ishifuku Metal Industry) fitted on its surface, on the side of the charge-generating layer with the thermocouple fitted thereto, according to a dipping method to thereby form a coating film having a dry thickness of 8 μm. Next, three conductive substrates each having the coating film formed in that manner were heated with a constant-temperature air drier (trade name, WINDY OVEN WFO-1001SD by Tokyo Rika Kikai) for 1 hour, 1.5 hours or 2 hours for which the temperature of the coating film could be 120° C. to form a charge-transporting layer on the conductive support, thereby constructing photoreceptors. A part of the charge-transporting layer was peeled off from each photoreceptor thus produced, and dissolved in acetone to thereby separate the insoluble binder resin. The resulting sample liquid was analyzed through liquid chromatography mass spectrometry (LC-MS) under the following condition, and based on the resulting results, a calibration curve of the standard substance (the charge-transporting substance of the butadiene compound T405; non-sublimable).

Device: Agilent 1100 Series (by Yokokawa Analytical Systems),

Column: Inertsil ODS-3, 2.1×100 mm (by GL Science),

Column temperature: 40° C.,

Eluent: methanol(MeOH)/$H_2O$=90/10 wt. %,

Injection amount: 5 μL,

Detector: 254 nm-UV detector.

From the determined value based on the calibration curve, the ratio of the hindered phenol compound to the standard substance (butadiene compound T405) was computed. In the charge-transporting layer formed of the coating liquid A and left as such under no heat for 4 days at room temperature (25° C.), the hindered phenol compound of the structural formula (1aa) existed in an amount of 30% by weight when the content of the charge-transporting substance of the butadiene compound was 100% by weight.

In the charge-transporting layer formed of the coating liquid B and the coating liquid C, the ratio of the hindered phenol compound to the standard substance (butadiene compound, T405) was computed, like in the charge-transporting layer formed of the coating liquid A. In the charge-transporting layer formed of the coating liquid B or C and left as such under no heat for 4 days at room temperature (25° C.), the hindered phenol compound of the structural formula (1ac) or the hindered phenol compound of the structural formula (4) existed in an amount of 30% by weight when the content of the charge-transporting substance was 100% by weight.

The relationship between the heating time for forming the charge-transporting layer by heating and drying the coating film at a heating temperature of 120° C., and the content of the hindered phenol compound in the charge-transporting layer after the heating is shown in Table 1.

TABLE 1

| | Heating time | | | |
|---|---|---|---|---|
| Sublimable antioxidant | Not heated | 1 hr | 1.5 hrs | 2 hrs |
| Structural formula (1aa) | 30 | 29.00 | 28.80 | 28.40 |
| Structural formula (1ac) | (wt. %) | 29.90 | 29 | 29 |
| Structural formula (4) | | 30 | 30 | 30 |

As in Table 1, it is known that, under the condition of the heating temperature of 120° C., the degree of sublimation of the sublimable antioxidant did not increase so much even though the heating time was prolonged, and the content of the hindered phenol compound in the charge-transporting layer in all samples was about 30% by weight.

Next, using the coating liquids A, B and C, a coating film was formed on a conductive substrate having a charge-transporting layer and an undercoat layer formed thereon and having a sheet thermocouple fitted thereto, on the side thereof having the thermocouple fitted to it, according to a dipping method, thereby forming a coating film having a dry thickness of 12 μm. Next, the conductive substrate with the coating film formed thereon was heated and dried at a heating temperature of 120° C., 130° C. or 135° C. for 1 hour, 1.5 hours or 2 hours in the same manner as above, thereby constructing photoreceptors each having the charge-transporting layer formed on the conductive substrate thereof. The content of the hindered phenol compound in the charge-transporting layer of the thus-formed photoreceptor was computed according to the same method as above. The relationship between the heating temperature and the heating time for forming the charge-transporting layer by heating and drying the coating film, and the content of the hindered phenol compound in the charge-transporting layer after the drying is shown in Table 2.

TABLE 2

| | Drying condition | | | | | | | | | |
|---|---|---|---|---|---|---|---|---|---|---|
| Sublimable | Not | 120° C. | | | 130° C. | | | 135° C. | | |
| antioxidant | heated | 1 hr | 1.5 hrs | 2 hrs | 1 hr | 1.5 hrs | 2 hrs | 1 hr | 1.5 hrs | 2 hrs |
| Structural formula (1aa) | 30 (wt. %) | 29.20 | 28.90 | 28.60 | 18.40 | 16.70 | 15.70 | 16.00 | 14.60 | 13.70 |
| Structural formula (1ac) | | 29.90 | 29.40 | 29.30 | 26.70 | 24.10 | 22.20 | 23.70 | 22.30 | 21.20 |
| Structural formula (4) | | 30 | 30 | 30 | 30 | 30 | 30 | 30 | 30 | 30 |

Table 2 confirms the following: The compound of the structural formula (4) is a hindered phenol compound but its sublimation temperature is high since the sum total of the atomic weight of the atoms constituting $R^1$ to $R^5$ in the formula (1) corresponding to the compound is larger than 400, and therefore the compound could sublime little at a heating temperature near to the suitable temperature in heating photoreceptor. As a result, the content of the compound of the structural formula (4) in the charge-transporting layer could not be reduced.

Regarding the hindered phenol compound of the structural formula (1aa) and the hindered phenol compound of the structural formula (1ac), the content of the hindered phenol compound in the charge-transporting layer was about 30% by weight at a heating temperature of 120° C. since the degree of sublimation of the compound is low. However, at a heating temperature higher than 120° C., the hindered phenol compound sublimed, and therefore the content of the compound in the charge-transporting layer was reduced. Accordingly, in the hindered phenol compound of the structural formula (1aa) and the hindered phenol compound of the structural formula (1ac), the sum total of the atomic weight of the atoms constituting $R^1$ to $R^5$ in the formula (1) that represents the compounds is small, falling from 117 to 400, and therefore the compounds sublime at a heating temperature falling within the suitable temperature range in heating photoreceptor, and the charge-transporting layers could be readily made to differ in point of the content of the sublimable antioxidant therein.

In that manner, the content of the sublimable antioxidant in the first charge-transporting layer 5 can be made to differ from the content of the sublimable antioxidant in the second charge-transporting layer 6 by changing the heating temperature in heating the two layers. When the hindered phenol compound of the formula (1) such as the compound of the structural formula (1aa) or (1ac) is used as the sublimable antioxidant, then the first coating film may be dried by heating it at a heating temperature higher than 120° C. in the first drying step and the second coating film may be dried by heating it at a temperature not higher than 120° C. in the second drying step, whereby the degree of sublimation of the sublimable antioxidant in the second drying step may be made lower than the degree of sublimation of the sublimable antioxidant in the first drying step.

In the method of making the content of the sublimable antioxidant in the first charge-transporting layer 5 differ from the content of the sublimable antioxidant in the second charge-transporting layer 6, the heating time and not the heating temperature may be changed between the first drying step and the second drying step.

As in Table 2, when the heating temperature is constant, then the degree of sublimation of the hindered phenol compound of the structural formula (1aa) or (1ac) may increase with the prolongation of the heating time, thereby resulting in that the content of the sublimable antioxidant in the charge-transporting layer may be lower. To that effect, the content of the sublimable antioxidant in the first charge-transporting layer 5 may be made to differ from the content of the sublimable antioxidant in the second charge-transporting layer 6 by changing the heating time for the layers. In this case, the heating temperature is preferably higher than 120° C.

The heating time in the first drying step and the second drying step is the heating temperature in the experiment shown in Table 2, or that is, the time for which the temperature of the coating film is 120° C., 130° C. or 135° C. Not limited thereto, a period of time for which the temperature of the coating film is higher than 120° C. may be employable herein. When the heating time in the second drying step is made shorter than the heating time in the first drying step, then the degree of sublimation of the sublimable antioxidant in the second drying step may be made lower than the degree of sublimation of the sublimable antioxidant in the first drying step with the result that the content of the sublimable antioxidant in the second charge-transporting layer 6 may be made higher than the content of the sublimable antioxidant in the first charge-transporting layer 5.

In the method of making the content of the sublimable antioxidant in the first charge-transporting layer 5 differ from the content of the sublimable antioxidant in the second charge-transporting layer 6, both the heating temperature and the heating time may be changed between the first drying step and the second drying step. On the other hand, for example, when the drier has a closed space for the first drying step and the second drying step, then the vapor pressure in the drier may be changed between the first drying step and the second drying step. The vapor pressure in the drier in the second drying step may be made higher than the vapor pressure in the drier in the first drying step, whereby the sublimation temperature of the sublimable antioxidant in the second drying step may be higher than the sublimation temperature of the sublimable antioxidant in the first drying step and therefore the sublimable antioxidant more hardly sublimes in the second drying step. In that manner, by changing the vapor pressure in the drier between the two steps, the degree of sublimation of the sublimable antioxidant in the first drying step may be made to differ from the degree of sublimation of the sublimable antioxidant in the second drying step.

The method for making the content of the sublimable antioxidant in the first charge-transporting layer 5 differ from the content of the antioxidant in the second charge-transporting layer 6 is not limited to the embodiments of changing the drying condition between the two layers, for which, for example, the coating condition may be changed between the first coating step and the second coating step. The coating condition in the first coating step and the second coating step is, for example, the thickness dimension of the first coating film to be formed in the first coating step and that of the second coating film to be formed in the second coating step.

The following experiment was carried out for confirming the fact that the content of the sublimable antioxidant in the first charge-transporting layer may be made to differ from the content of the sublimable antioxidant in the second charge-transporting layer by making the thickness of the first coating film to be formed in the first coating step differ from the thickness of the second coating film to be formed in the second coating step.

Using the above-mentioned coating liquids A and B, a coating film having a dry thickness of 8 μm, 12 μm or 20 μm was formed on a conductive substrate having a charge-generating layer and an undercoat layer formed thereon and having a sheet thermocouple fitted thereto, on the side thereof with the thermocouple fitted to it, according to a dipping method. Next, the conductive substrate with the coating film formed thereon was heated in the same manner as above for 1 hour at 130° C., thereby constructing a photoreceptor having a charge-transporting layer formed on the conductive substrate. Similarly using the coating liquids A and B, a coating film having a dry thickness of 20 μm was formed on a conductive substrate having a charge-generating layer and an undercoat layer formed thereon, and then dried at a heating temperature of 135° C. for 1 hour, thereby forming a charge-transporting layer. In that manner, a photoreceptor having a charge-transporting layer formed thereon was constructed, and the content of the hindered phenol compound in the charge-transporting layer therein was computed according to the same method as above. The relationship between the dry thickness of the coating film, and the content of the sublimable antioxidant in the heated charge-transporting layer is shown in Table 3.

TABLE 3

| | Drying condition | Not heated | 130° C./hr | | | 135° C./hr |
|---|---|---|---|---|---|---|
| | Thickness of Charge-transporting layer | — | 8 μm | 12 μm | 20 μm | 20 μm |
| Antioxidant | Structural formula (1aa) | 30 (wt. %) | 15.00 | 18.40 | 21.00 | 16.00 |
| | Structural formula (1ac) | | 25.00 | 26.70 | 27.10 | 23.70 |

As in Table 3, even though under the same drying condition of the same heating temperature and the same heating time, the content of the sublimable antioxidant may be made to differ between the charge-transporting layers by applying the coating liquid in such a manner that the coating films formed in the coating steps could differ in point of the thickness thereof. More concretely, by applying the coating liquid in the first coating step and in the second coating step in such a manner that the dry thickness of the second charge-transporting layer could be larger than the dry thickness of the first charge-transporting layer, the content of the sublimable antioxidant in the second charge-transporting layer may be made higher than the content of the sublimable antioxidant in the first charge-transporting layer even under the same drying condition of the same heating temperature and the same heating time.

In that manner, by changing the drying condition or the coating condition, the content of the sublimable antioxidant in the first charge-generating layer 5 may be made to differ from the content of the sublimable antioxidant in the second charge-transporting layer 6.

The content of the sublimable antioxidant, or that is the ratio of the weight of the sublimable antioxidant to the weight of the charge-transporting substance in the first charge-transporting layer 5 after the first drying step may be any one lower than the content of the sublimable antioxidant in the second charge-transporting layer 6 after the second drying step.

The ratio of the content of the sublimable antioxidant in the first charge-transporting layer to the content of the sublimable antioxidant in the second charge-transporting layer (content of the sublimable antioxidant in the first charge-transporting layer/content of the sublimable antioxidant in the second charge-transporting layer) is preferably from 60% to less than 100%.

The content of the sublimable antioxidant, or that is the ratio of the weight of the sublimable antioxidant to the weight of the charge-transporting substance in the first charge-transporting layer 5 after the first drying step is preferably at most 27% by weight, more preferably less than 20% by weight. When the content of the sublimable antioxidant in the first charge-transporting layer 5 is more than 27% by weight, then the content of the sublimable antioxidant in the charge-transporting layer 7 may be too high as a whole and the electric properties of the layer may worsen.

The content of the sublimable antioxidant, or that is, the ratio of the weight of the sublimable antioxidant to the weight of the charge-transporting substance in the second charge-transporting layer 6 after the second drying step is preferably at least 28% by weight, most preferably about 30% by weight. When the content of the sublimable antioxidant in the second charge-transporting layer 6 is less than 28% by weight, then the layer could not be sufficiently resistant to oxidizing gas. In order that the content of the sublimable antioxidant in the first charge-transporting layer 5 and in the second charge-transporting layer 6 may be within the above-mentioned preferred range, the content of the sublimable antioxidant in the coating liquid is preferably from 28% by weight to 45% by weight.

In the manner as above, the second drying step is carried out so that the degree of sublimation of the sublimable antioxidant in the second drying step may be lower than the degree of sublimation of the sublimable antioxidant in the first drying step, thereby forming the second charge-transporting layer. Through these steps, the production of the photoreceptor 1 is finished, which has a charge-transporting layer 7 and in which the content of the sublimable antioxidant in the second charge-transporting layer 6 is higher than the content of the sublimable antioxidant in the first charge-transporting layer 5.

Figure 3:
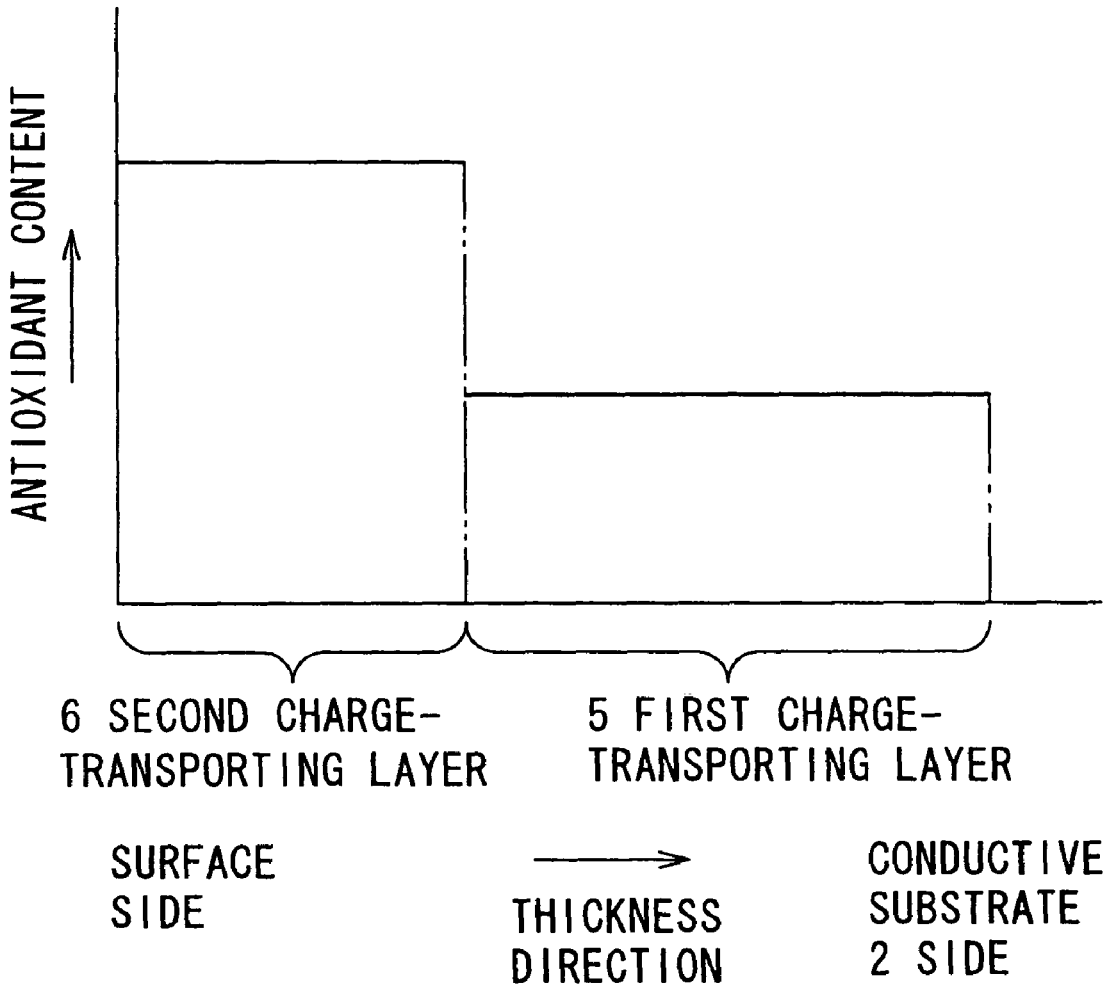
FIG. 3 is a graph showing the content of the sublimable antioxidant in a first charge-transporting layer and a second charge-transporting layer of the electrophotographic photoreceptor produced according to the electrophotographic photoreceptor production method of the invention.

FIG. 3 is a graph showing the content of the sublimable antioxidant in the first charge-transporting layer 5 and the second charge-transporting layer 6 of the photoreceptor 1 produced according to the photoreceptor production method of the invention. In the production method for the photoreceptor 1 of the invention, the content of the sublimable antioxidant in the second charge-transporting layer 6, which is remoter from the conductive substrate 2 than the first charge-transporting layer 5 and which is nearer to the surface of the photoreceptor 1, may be made larger than the content of the sublimable antioxidant in the first charge-transporting layer 5, as in FIG. 3.

In the photoreceptor 1 that has the charge-transporting layer 7 of the type, the charge-transporting substance existing in and around the surface of the second charge-transporting layer 6 that is near to the surface of the photoreceptor 1 may be prevented from being oxidized, and the resistance to oxidizing gas of the charge-transporting layer 7 may be thereby improved. Of the first charge-transporting layer remoter from the surface of the photoreceptor 1 than the second charge-transporting layer, the electric properties may be prevented from being worsened by the increase in the content of the sublimable antioxidant in the first charge-transporting layer. Accordingly, the photoreceptor 1 produced herein is resistant to oxidizing gas, in which all of the charge-transporting layer that comprises the first charge-transporting layer and the second charge-transporting layer, or that is, the photoreceptor layer as a whole may have excellent electric properties and characteristic stability.

Since the same coating liquid is used for forming the first charge-transporting layer and the second charge-transporting layer that differ in point of the content of the sublimable antioxidant therein, it is unnecessary to increase the number of the types of the coating liquids for forming the photosensitive layer as compared with a case where different coating liquids are used separately for forming the first charge-transporting layer and the second charge-transporting layer. Accordingly, the invention is free from a complicated requirement for viscosity control of coating liquids and may therefore prevent the increase in the production equipment investment and in the cost of solvent for use for the viscosity control.

A process for forming an electrostatic latent image on the photoreceptor 1 is described briefly hereinunder. The photosensitive layer 8 provided in the photoreceptor 1 is uniformly charged, for example, negatively by a charger, and when the charge-generating layer 4 is irradiated with light having a wavelength capable of being absorbed by the layer while the photoreceptor 1 is thus charged, then the charge-generating layer 4 generates charges of electrons and holes. The holes are transported by the charge-transporting substance in the charge-transporting layer 7 to the surface of the photoreceptor 1 to thereby neutralize the negative charges on the surface, while the electrons in the charge-generating layer 4 move toward the side of the conductive substrate 2 having positive charges induced therein, to thereby neutralize the positive charges. In that manner, there occurs a difference between the charge amount in the exposed site and the charge amount in the non-exposed site, and an electrostatic latent image is thereby formed on the photosensitive layer 8.

In this embodiment, the photosensitive layer 8 has a laminate structure of the charge-generating layer 4 and the charge-transporting layer 7. In that manner, the different layers may be made to separately have the charge-generating function and the charge-transporting function, and a most suitable material may be selected as the material to constitute each layer for the charge-generating function and the charge-transporting function thereof. Accordingly, the photoreceptor 1 produced herein may have extremely good photosensitivity, charging characteristics and image reproducibility.

Not limited to the above, the production method for the photoreceptor 1 of the invention may be variously changed and modified. For example, the charge-transporting layer 7 is not limited to the constitution that comprises the first charge-transporting layer and the second charge-transporting layer, but may have a multilayer structure of 3 or more layers. When the charge-transporting layer has a multilayer structure of 3 or more layers, then the same coating liquid may be used for forming the layers.

In case where the charge-transporting layer has a multilayer structure of 3 or more layers, the drying step is preferably so controlled that the content of the sublimable antioxidant in the charge-transporting layer remoter from the conductive substrate, or that is, the layer nearer to the surface of the photoreceptor 1 may be higher and that the content of the sublimable antioxidant in the charge-transporting layer nearer to the conductive substrate, or that is, the layer remoter from the surface of the photoreceptor 1 may be lower. Accordingly, the content of the sublimable antioxidant in the charge-transporting layer may have a gradation profile with the result that the photoconductive substance in and around the surface of the photosensitive layer nearer to the outer surface of the photoreceptor may be resistant to oxidizing gas and that the content of the sublimable antioxidant in all the photosensitive layer may be reduced, and therefore the photoreceptor produced herein may have excellent electric properties.

Figure 4:
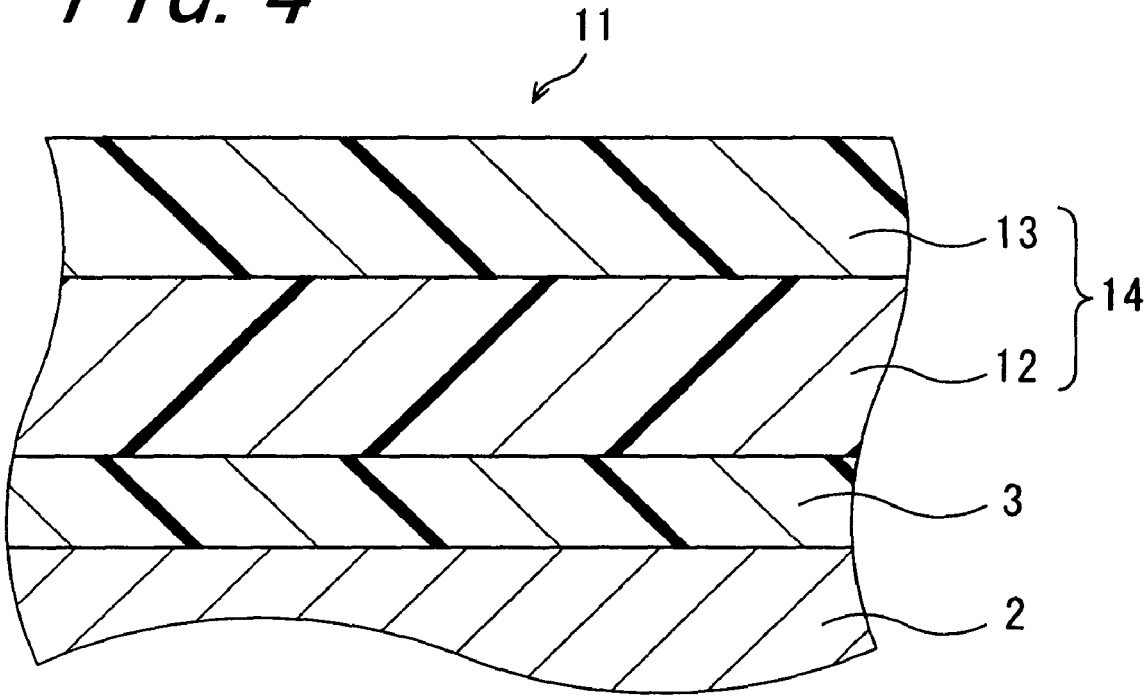
FIG. 4 is a partial cross-sectional view showing, in a simplified manner, the constitution of an electrophotographic photoreceptor that is produced according to the production method for electrophotographic photoreceptor according to a second embodiment of the invention.

FIG. 4 is a partial cross-sectional view showing, in a simplified manner, the constitution of a photoreceptor 11 that is produced according to the production method for electrophotographic photoreceptor of the second embodiment of the invention. The photoreceptor 11 produced according to the photoreceptor production method of this embodiment is similar to the photoreceptor 1 of the first embodiment shown in FIG. 2, in which, therefore, the parts common to the two are represented by the same reference numerals and their description is omitted herein. The matter specifically noted in the photoreceptor 11 is that the photoreceptor has, as formed on an undercoat layer 3, a photosensitive layer 14 that comprises a first photosensitive layer 12 and a second photosensitive layer 13 containing both a charge-generating substance and a charge-transporting substance.

The production method of this embodiment is for producing the photoreceptor 11 having, on a conductive substrate 2, at least the first photosensitive layer 12 and the second photosensitive layer 13 laminated thereon in that order, and the method comprises a first coating step of applying a coating liquid that contains a photosensitive substance, or that is, a charge-generating substance and a charge-transporting substance, and a sublimable antioxidant, onto the conductive substrate 2 to thereby form a first coating film, a first drying step of heating and drying the formed first coating film to form the first photosensitive layer 12, a second coating step of applying the coating liquid used in the first coating step onto the first photosensitive layer 12 to form a second coating film, and a second drying step of heating and drying the formed second coating film to form the second photosensitive layer 13, in which, in the second drying step, the drying condition is made to differ from the drying condition in the first drying step so that the degree of sublimation of the sublimable antioxidant in the second drying step may be lower than the degree of sublimation of the sublimable antioxidant in the first drying step.

The production method for the photoreceptor 11 of this embodiment is the same as the production method for the photoreceptor 1 of the first embodiment mentioned hereinabove, except that, in the former, the coating liquid for photosensitive layer formation used in the first coating step and in the second coating step contains a charge-generating substance such as that mentioned above and that the former does not include a step for forming a charge-generating layer.

The photoreceptor 11 of this embodiment is suitable as a photoreceptor for plus-charging image forming apparatus that may generate little ozone. In the photoreceptor 11 of this embodiment, only two layers of the first photosensitive layer 12 and the second photosensitive layer 13 are formed on the undercoat layer 3, and therefore, as compared with the photoreceptor 1 produced according to the photoreceptor production method of the first embodiment where the charge-generating layer 4, the first charge-transporting layer 5 and the second charge-transporting layer 6 are laminated on the undercoat layer 3, the photoreceptor 11 is excellent as its production cost is low and its yield is high.

A process for forming an electrostatic latent image on the photoreceptor 11 is described briefly hereinunder. The photosensitive layer 14 provided in the photoreceptor 11 is uniformly charged, for example, positively by a charger, and when the charge-generating substance is irradiated with light having a wavelength capable of being absorbed by the substance while the photoreceptor 11 is thus charged, then the photosensitive layer 14 generates charges of electrons and holes in and around its surface. The electrons neutralize the positive charges in and around the surface of the photosensitive layer 14; while the holes are transported by the charge-transporting substance to the side of the conductive substrate 2 having negative charges induced therein, to thereby neutralize the negative charges induced in the conductive substrate 2. In that manner, there occurs a difference between the charge amount in the exposed site and the charge amount in the non-exposed site, and an electrostatic latent image is thereby formed on the photosensitive layer 14.

According to the photoreceptor production method of this embodiment, a first photosensitive layer and a second photosensitive layer are formed as the photosensitive layer that contains a photoconductive substance, or that is, a charge-generating substance and a charge-transporting substance, and the content of the sublimable antioxidant in the second photosensitive layer may be made higher than the content of the sublimable antioxidant in the first photosensitive layer. Accordingly, in the photoreceptor 11 thus produced, the resistance to oxidizing gas of the photosensitive layer 14 is ensured, not increasing the number of the types of the coating liquids necessary for it, and the electric properties and the characteristic stability of the photoreceptor 11 are prevented from worsening.

In this embodiment, the photosensitive layer 14 is formed of the two layers, the first photosensitive layer 12 and the second photosensitive layer 13, to which, however, the invention should not be limited. The photosensitive layer may be formed of 3 or more layers. In such a case, the same coating liquid is used for forming the layers, and the layer configuration is preferably so designed that the content of the sublimable antioxidant in the layers remoter from the surface of the photoreceptor could be lower.

Figure 5:
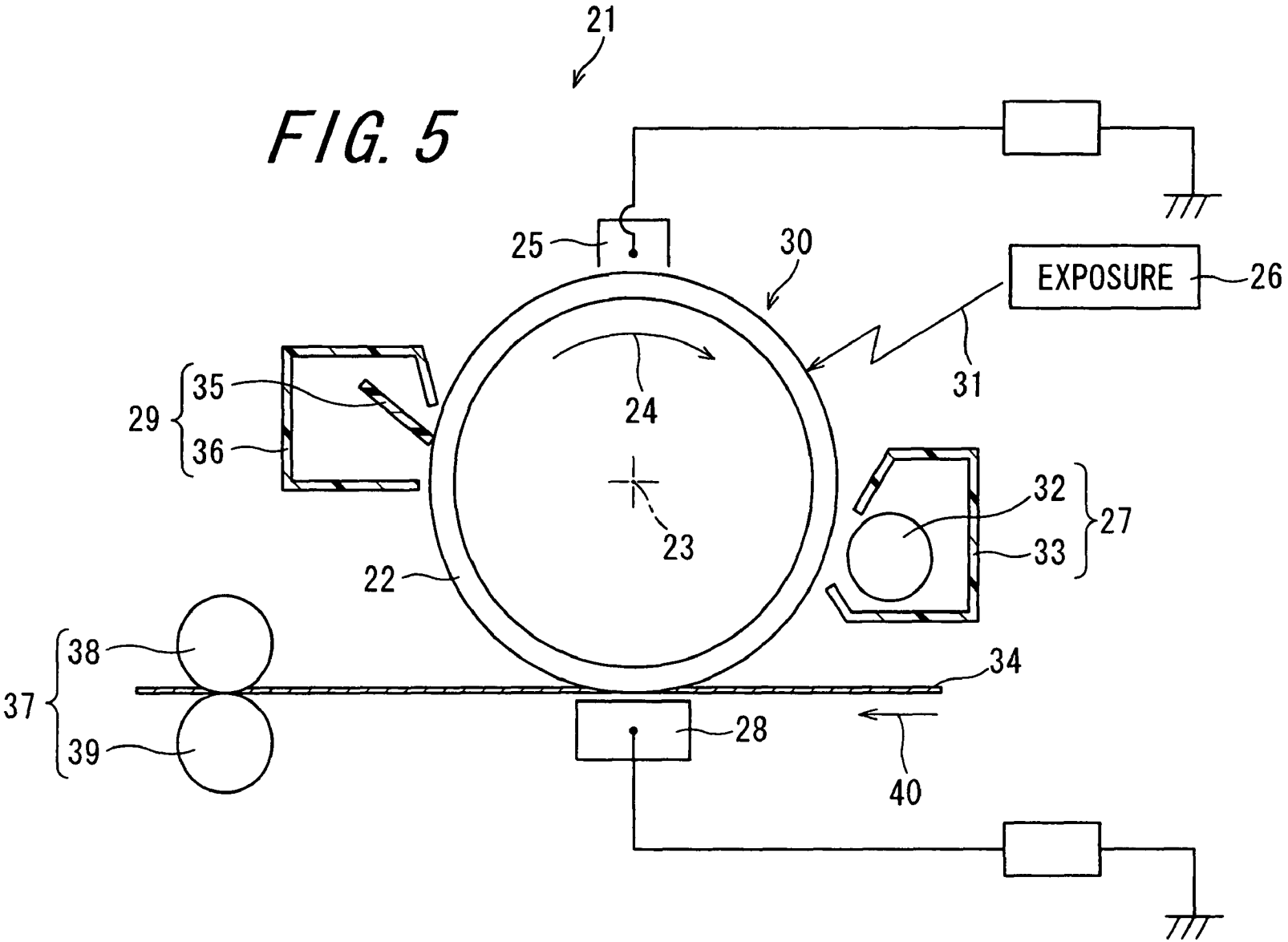
FIG. 5 is a layout side view showing, in a simplified manner, the constitution of an image forming apparatus equipped with the electrophotographic photoreceptor produced according to the electrophotographic photoreceptor production method of the invention.

FIG. 5 is a layout side view showing, in a simplified manner, the constitution of an image forming apparatus 21 equipped with the photoreceptor produced according to the photoreceptor production method of the invention. The image forming apparatus 21 shown in FIG. 5 has, as mounted thereon, the cylindrical photoreceptor 1 shown in FIG. 2 as a type of the photoreceptor produced according to the photoreceptor production method of the invention.

The image forming apparatus 21 comprises the photoreceptor 22 rotatably supported by the body of the apparatus (not shown), and a driving structure (not shown) for rotating and driving the photoreceptor 22 toward the direction of the arrow 24 around the rotation axis line 23. The driving structure is provided with, for example, a motor as a power source, and it transmits the power from the motor to the conductive substrate that constitutes the core of the photoreceptor 22, via a gear (not shown), whereby the photoreceptor 22 is rotated and driven at a predetermined peripheral speed.

Around the photoreceptor 22, provided are a charger 25, an exposure unit 26, a developing unit 27, a transfer unit 28, a cleaner 26 in that order from the upstream side to the downstream side in the rotation direction of the photoreceptor 22 shown by the arrow 24. The cleaner 29 is provided along with a discharging lamp (not shown).

The charger 25 is a charging unit for charging the surface 30 of the photoreceptor 22 at a predetermined potential. The charger 25 is, for example, a non-contact charging unit such as a corona-discharge charger.

The exposure unit 26 is provided with, for example, a semiconductor laser as a light source, and the surface 30 of the charged photoreceptor 22 is exposed to light such as the laser light 31 outputted by the light source in accordance with the image information applied thereto, whereby an electrostatic latent image is formed on the surface 30 of the photoreceptor 22.

The developing unit 27 is a developing unit for developing the electrostatic latent image formed on the surface of the photoreceptor 22, with a developer, to thereby from a visible image, or that is, a toner image. The developing unit 27 comprises a developing roller 32 that is equipped to face the photoreceptor 22 and supplies a toner to the surface 30 of the photoreceptor 22, and a casing 33 that supports the developing roller 32 rotatably around the rotation axis line thereof set parallel to the rotation axis line 23 of the photoreceptor 22 and houses a toner-containing developer in the space inside it.

The transfer unit 28 is a transfer unit for transferring the toner image formed on the surface 30 of the photoreceptor 22, onto recording paper 34 of a recording medium from the surface 30 of the photoreceptor 22. The transfer unit 28 is a non-contact transfer unit that comprises, for example, a charging unit such as a corona-discharge charger and gives charges of reverse polarity to the toner, to the recording paper 34, whereby the toner image is transferred onto the recording paper 34.

The cleaner 29 is a cleaning unit for cleaning the surface 30 of the photoreceptor 22 from which the toner image has been transferred. The cleaner 29 comprises a cleaning blade 35 that is kept in elastic contact with the photoreceptor surface 30 to peel the impurities such as toner and paper dust still remaining on the surface 30 of the photoreceptor 22 after the transference operation with the transfer unit 28, from the surface 30, and a recovery casing 36 for housing therein the impurities such as toner peeled by the cleaning blade 35. The toner to form the toner image on the surface 30 of the photoreceptor 22 is not all transferred onto the recording paper 34, but may slightly remain on the surface 30 of the photoreceptor 22. The toner remaining on the photoreceptor surface 30 is referred to as a residual toner, and the presence of the residual toner may cause the quality degradation of the formed image. Accordingly, with the cleaning blade 35 that is kept in contact with the photoreceptor surface 30, the residual toner is removed from the surface 30 of the photoreceptor 22 along with the other impurities such as paper dust.

On the more downstream side in the recording paper conveying direction than the transfer position of the toner image from the photoreceptor 22 to the recording paper 34 by the transfer unit 28 is provided a fixing unit 37 to fix the toner image transferred to the recording paper 34. The fixing unit 37 comprises a heating roller 38 having a heating structure (not shown), and a pressure roller 39 that is provided in opposite to the heating roller 38 and is kept in elastic contact with the heating roller 38 to form a contact part therebetween.

The image forming apparatus 21 of the type forms an image through electrophotography, and is mounted on a duplicator, a printer, a facsimile. The electrophotography is a type of an information-recording system that utilizes the photoconductive phenomenon of the photoreceptor 22, and this is to form an image according to an electrophotographic process mentioned below.

According to the instruction by a control unit (not shown), the photoreceptor 22 is rotated and driven in the direction of the arrow 24, and its surface is positively or negatively charged at a predetermined potential by the charger 25 provided on the more upstream side in the rotation direction of the photoreceptor 22 than the position at which the photoreceptor receives the light 31 from the exposing unit 26.

Next, according to the instruction by the control unit, the exposing unit 26 give the light 31 to the surface 30 of the charged photoreceptor 22. The light 31 from the light source is repeatedly scanned in the rotation axis line direction of the photoreceptor 22 that is the main scanning direction thereof, on the basis of the image information applied thereto. When the photoreceptor 22 is rotated and driven and when the light 31 from the light source is repeatedly scanned thereon on the basis of the image information applied thereto, then the surface 30 of the photoreceptor 22 may be exposed to the light in accordance with the image information. Through the exposure, the surface charges in the part exposed to the light 31 reduce, therefore producing a difference between the surface potential in the part exposed to the light 31 and the surface potential in the part not exposed to the light 31, and an electrostatic latent image is thereby formed on the surface 30 of the photoreceptor 22. The recording paper 34 is fed in the direction of the arrow 40 to the transfer position between the transfer unit 28 and the photoreceptor 22 by a conveyor unit (not shown).

Next, by the developing roller 32 of the developing unit 27 that is provided on the more downstream side in the rotation direction of the photoreceptor 22 than the position at which the photoreceptor receives the light 31 from the light source, a visible image, or that is, a toner image is formed on the surface 30 of the photoreceptor 22 having the electrostatic latent image formed thereon. When recording paper 34 is fed between the photoreceptor 22 and the transfer unit 28, then charges of opposite polarity to the toner are given to the recording paper 34 by the transfer unit 28, whereby the toner image formed on the surface 30 of the photoreceptor 22 is transferred onto the recording paper 34.

The recording paper 34 having the toner image transferred thereon is conveyed to the fixing unit 37 by a conveyor structure, and when it passes between the heating roller 38 and the pressure roller 39 of the fixing unit 37, it is heated and pressed while being sandwiched between the heating roller 38 and the pressure roller 39. Accordingly, the toner image on the recording paper 34 is fixed on the recording paper 34 to be a fast-color image. The recording paper 34 with the image thus formed thereon is delivered outside the image forming apparatus 21 by a conveyor structure.

After the toner image has been transferred onto the recording paper 34, the photoreceptor 22 further rotates in the direction of the arrow 24, and its surface 30 is rubbed with the cleaning blade 35 equipped in the cleaner 29, and is thereby cleaned. In that manner, the surface 30 of the photoreceptor 22 from which the impurities such as toner have been removed is discharged by the light from a discharger lamp. Accordingly, the electrostatic latent image on the surface 30 of the photoreceptor 22 disappears. After this, the photoreceptor 22 is further rotated and driven, and then again subjected to a series of the operation that starts from charging of the photoreceptor 22. As in the above, images may be formed continuously.

The technology of electrophotography as above is not limited to the field of duplicators, but may also be utilized in other fields of printing plate materials, slide films, microfilms and others for which silver salt photography has been used.

The photoreceptor 22 produced according to the production method of the invention has good electric properties and has excellent characteristic stability since the resistance to oxidizing gas of the photoconductive substance therein is improved. The image forming apparatus 21 comprises the photoreceptor 22 as mounted thereon, and may form good images free from image failures of white skipping or dark stripes even in repeated use.

As described hereinabove, the photoreceptor 22 mounted on the image forming apparatus 21 of this embodiment is the photoreceptor 1 of the first embodiment shown in FIG. 2. The photoreceptor 22 is not limited to the constitution as above, but may have, for example, the same layer constitution as that in the photoreceptor 11 of the second embodiment shown in FIG. 4.

The image forming apparatus of the invention is not limited to the constitution of the image forming apparatus 21 shown in FIG. 5 mentioned above, but may have any other constitution that uses the photoreceptor produced according to the production method of the invention.

For example, in the image forming apparatus 21 of this embodiment, the exposing unit 26 is a semiconductor laser, but it may also be a light emitting diode (LED) or a cathode ray tube (CRT). The charging unit 25 is a non-contact charging unit, but not limited thereto, this may also be a contact charging unit such as a charging roller. The transfer unit 28 is a non-contact transfer unit not requiring pushing pressure for transference, but not limited thereto, this may also be a contact transfer unit requiring pushing pressure for transference. The contact transfer unit usable herein comprises, for example, a transfer roller, in which the transfer roller is pressed to the photoreceptor 22 from the surface of the recording paper 34 opposite to the contact surface thereof with the surface 30 of the photoreceptor 22, and while the photoreceptor 22 and the recording paper 34 are thus kept in contact under pressure, charges of opposite polarity to toner are given to the recording paper 34 by the transfer roller to thereby transfer the toner image onto the recording paper 34.

In the image forming apparatus 21 of the type, the photoreceptor 22 has good photosensitivity and photo-responsiveness, and even in repeated use, its photosensitivity and photo-responsiveness do not lower, and therefore good images with neither white skipping nor black stripes may be formed for a long period of time.

EXAMPLES

Examples of the invention are described below.

Example 1

An undercoat layer forming step, a charge-generating layer forming step, a first coating step, a first drying step, a second coating step and a second drying step were carried out in the manner mentioned below, thereby forming an undercoat layer, a charge-generating layer, a first charge-transporting layer and a second charge-transporting layer, on the outer peripheral surface of a cylindrical conductive substrate of aluminium having an outer diameter of 30 mm and a length in the lengthwise direction of 346 mm to construct a photoreceptor of Example 1.

Undercoat Layer-Forming Step:

3 parts by weight of titanium oxide (trade name, TTO-D1 (dendritic rutile type surface-treated with $Al_2O_3$ and $ZrO_2$, having a titanium content of 85%), by Ishihara Sangyo), and 3 parts by weight of alcohol-soluble nylon resin (trade name, CM8000, by Toray) were added to a mixed solvent of 60 parts by weight of methanol and 40 parts by weight of 1,3-dioxolan, and dispersed with a paint shaker for 10 hours to prepare a coating liquid for undercoat layer formation. The coating liquid was filled in a coating liquid tank, then the conductive substrate was dipped therein and pulled out, and spontaneously dried to form thereon an undercoat layer having a thickness dimension of 0.9 μm.

Charge-Generating Layer-Forming Step:

10 parts by weight of polyvinyl butyral resin (trade name, S-LEC BL-2 by Sekisui Chemical Industry), 1400 parts by weight of 1,3-dioxolan, and 15 parts by weight of titanylphthalocyanine (of the formula (2) where $R^{11}$, $R^{12}$, $R^{13}$ and $R^{14}$ are hydrogen atoms, and r, s, y and z are 4) were dispersed in a ball mill for 72 hours to prepare a coating liquid for charge-generating layer formation. The coating liquid was applied onto the previously-formed undercoat layer according to the same dipping method as that for the undercoat layer formation, and then spontaneously dried to form thereon a charge-generating layer having a thickness dimension of 0.2 μm.

First Coating Step:

100 parts by weight of a charge-transporting substance, butadiene compound of the structural formula (3) (trade name, T405 by Takasago Chemical), 200 parts by weight of a binder resin TS2020 (trade name by Teijin Chemical), and 30 parts by weight of a sublimable antioxidant, hindered phenol compound of the structural formula (1aa) were mixed, and dispersed in 980 parts by weight of tetrahydrofuran to prepare a coating liquid for charge-transporting layer formation. The coating liquid was applied onto the previously-formed charge-generating layer according to the same dipping method as that for the undercoat layer formation, thereby forming a first coating film thereon.

First Drying Step:

The formed first coating film was heated and dried with a constant-temperature air drier (trade name, WINDY OVEN WFO-1001SD by Tokyo Rika Kikai) at a heating temperature of 130° C. for a heating time of 1 hour, thereby forming a first charge-transporting layer having a thickness dimension of 12 μm. The heating temperature was determined by measuring the temperature of the coating film formed on a photoreceptor for heating temperature measurement, which was produced separately in the same manner as that for the photoreceptor of Example 1, using a Cu—Ni alloy T-thermocouple (by Ishifuku Metal Industry).

Second Coating Step:

The coating liquid prepared in the first coating step was applied onto the previously-formed first charge-transporting layer according to the same dipping method as that for the undercoat layer formation, thereby forming a second coating film thereon.

Second Drying Step:

The formed second coating film was heated and dried in the same manner as that for the first drying step, for which, however, the heating temperature was 120° C. and the heating time was 1 hour, thereby forming a second charge-transporting layer having a thickness dimension of 8 μm.

Example 2

A photoreceptor of Example 2 was produced in the same manner as in Example 1, for which, however, the hindered phenol compound of the structural formula (1ac) was used as the sublimable antioxidant.

Example 3

A photoreceptor of Example 3 was produced in the same manner as in Example 1, for which, however, the heating temperature in the first drying step was 135° C.

Example 4

A photoreceptor of Example 4 was produced in the same manner as in Example 1, for which, however, the hindered phenol compound of the structural formula (1ac) was used as the sublimable antioxidant and the heating temperature in the first drying step was 135° C.

Example 5

A photoreceptor of Example 5 was produced in the same manner as in Example 1, for which, however, the heating time in the first drying step was 1.5 hours.

Comparative Example 1

A photoreceptor of Comparative Example 1 was produced in the same manner as in Example 1, for which, however, the hindered phenol compound of the structural formula (4) was used as the sublimable antioxidant.

Comparative Example 2

A photoreceptor of Comparative Example 2 was produced in the same manner as in Example 1, for which, however, a charge-transporting layer having a thickness of 20 μm was formed in the first coating step and the first drying step but the second coating step and the second drying step were not carried out.

Comparative Example 3

A photoreceptor of Comparative Example 3 was produced in the same manner as in Comparative Example 2, for which, however, the heating temperature in the first drying step was 120° C.

The photoreceptors of Examples 1 to 5 and Comparative Examples 1 to 3 produced in the manner as above were tested and evaluated for the electric properties and the resistance to oxidizing gas thereof, in the manner mentioned below. From the test results of the electric properties and the resistance to oxidizing gas, the photoreceptors were totally evaluated in the manner mentioned below.

Evaluation of Electric Properties of Photoreceptor:

Each photoreceptor of Examples 1 to 5 and Comparative Examples 1 to 3 was mounted on an image forming apparatus (a commercially-available laser printer, trade name: AR-450 by Sharp, in which the photoreceptor was removed), and tested for its photo-responsiveness under a low temperature/low humidity (L/L) condition at a temperature of 5° C. and a relative humidity of 20%, and under a high temperature/high humidity (H/H) condition at a temperature of 35° C. and a relative humidity of 85%, according to the method mentioned below. The image forming apparatus was equipped with a corona-discharge charger as the charging unit for charging the photoreceptor. In addition, the image forming apparatus was provided with a surface potentiometer (trade name, CATE751, by Jentec) capable of measuring the surface potential of the photoreceptor during the image forming process with it. The laser printer AR-450 is a minus charge-type image forming apparatus for electrophotography, in which the surface of the photoreceptor is charged negatively.

Using the image forming apparatus with the photoreceptor of Examples 1 to 5 and Comparative Examples 1 to 3 mounted thereon, the photoreceptor surface was charged at minus (−)550 V from the ground potential, by the charging unit therein, then exposed to laser light, and immediately after it, the surface potential of the photoreceptor was measured, and its absolute value is the exposure potential VL [V]. When the exposure potential VL is smaller, then the photoreceptor has good photo-responsiveness. The evaluation standards are as follows:

Excellent: In L/L condition, VL is at most 135V, and in H/H condition, VL is at most 40 V.

Good: In L/L condition, VL is from more than 135V to 170 V, and in H/H condition, VL is from more than 40 V to 80 V.

Not Good: In L/L condition, VL is more than 170 V, and in H/H condition, VL is more than 80 V.

Evaluation of Resistance to Oxidizing Gas:

Each photoreceptor of Examples 1 to 5 and Comparative Examples 1 to 3 was mounted on a commercially-available full-color duplicator equipped with a corona-discharge charger as the charging unit for charging the photoreceptor therein (trade name, ARC-150 by Sharp), with which a test image of a predetermined pattern was continuously copied on 5000 sheets of copying paper, under L/L condition at a temperature of 5° C. and a relative humidity of 20%. The duplicator was once put off, then left overnight (about 20 hours) as such, and thereafter it was again put on and driven for copying a half-tone image on recording paper. This is an image for evaluation. The halftone image as referred to herein is an image of which the density is gradationally expressed by black-and-white dots.

The image for evaluation thus formed was visually checked as to whether the dots are blurred or not, or that is, as to whether the image is blurred or not. It was further checked as to whether the part of the recording paper that corresponds to the part on which the toner image was transferred from the part of the photoreceptor kept nearest to the corona-discharge charger while the duplicator was kept put off, has white skipping and black stripes. Based on these test results, the resistance to oxidizing gas of the photoreceptor was evaluated in point of the image failures such as image blurring, white skipping and black stripes having occurred therein. The resistance to oxidizing gas of the photoreceptor is evaluated according to the following standards:

Excellent: No image failure occurred.

Good: Some image failures occurred, but negligible.

Not Good: Many image failures occurred, and the photoreceptor is impracticable.

Total Evaluation:

Based on the test results for electric properties and the test results for resistance to oxidizing gas, the tested photoreceptor was totally evaluated. The evaluation standards are as follows:

Excellent: Both the test results for electric properties and the test results for resistance to oxidizing gas are excellent, and the photoreceptor is excellent.

Good: Both the test results for electric properties and the test results for resistance to oxidizing gas are good, and the photoreceptor is on a practicable level with no problem.

Not Good: Either the test results for electric properties or the test results for resistance to oxidizing gas are not good.

The test results for the electric properties and the resistance to oxidizing gas of the photoreceptors of Examples 1 to 5 and Comparative Examples 1 to 3 and the total evaluation results thereof are shown in Table 4.

TABLE 4

| | | First charge-transporting layer | | |
|---|---|---|---|---|
| | Structural formula of Antioxidant | Thickness (μm) | Heating temperature (° C.) | Heating time (hr) |
| Example 1 | (1aa) | 12 | 130 | 1 |
| Example 2 | (1ac) | 12 | 130 | 1 |
| Example 3 | (1aa) | 12 | 135 | 1 |
| Example 4 | (1ac) | 12 | 135 | 1 |
| Example 5 | (1aa) | 12 | 130 | 1.5 |
| Comparative Example 1 | (4) | 12 | 130 | 1 |
| Comparative Example 2 | (1aa) | 20 | 130 | 1 |
| Comparative Example 3 | (1aa) | 20 | 120 | 1 |

| | Second charge-transporting layer | | |
|---|---|---|---|
| | Thickness (μm) | Heating temperature (° C.) | Heating time (hr) |
| Example 1 | 8 | 120 | 1 |
| Example 2 | 8 | 120 | 1 |
| Example 3 | 8 | 120 | 1 |
| Example 4 | 8 | 120 | 1 |
| Example 5 | 8 | 120 | 1 |
| Comparative Example 1 | 8 | 120 | 1 |
| Comparative Example 2 | | — | |
| Comparative Example 3 | | — | |

| | Electric properties | | | | |
|---|---|---|---|---|---|
| | VL (V) | | | Resistance | Total |
| | L/L | H/H | Evaluation | evaluation | evaluation |
| Example 1 | 105 | 32 | Excellent | Excellent | Excellent |
| Example 2 | 145 | 50 | Good | Excellent | Good |
| Example 3 | 98 | 29 | Excellent | Good | Good |
| Example 4 | 135 | 42 | Good | Excellent | Good |
| Example 5 | 97 | 29 | Excellent | Good | Good |
| Comparative Example 1 | 210 | 98 | Not Good | Excellent | Not Good |
| Comparative Example 2 | 130 | 32 | Excellent | Not Good | Not Good |
| Comparative Example 3 | 172 | 88 | Not Good | Excellent | Not Good |

As in Table 4, in case where the compound of the structural formula (4) was used as the antioxidant (Comparative Example 1), the compound of the structural formula (4) has a high sublimation temperature and therefore could not sublime at the heating temperature of 130° C. or so, and therefore the first charge-transporting layer and the second charge-transporting layer could not be made to differ in point of the content of the antioxidant in the layers. Accordingly, the content of the antioxidant in the first charge-transporting layer nearer to the conductive substrate could not be lowered, and the exposure potential VL of the photoreceptor was high both under the H/H condition and under the L/L condition, and the photo-responsiveness of the photoreceptor was poor.

In case where the charge-transporting layer is a single layer (Comparative Examples 2 and 3), the sublimable antioxidant exists uniformly in the entire charge-transporting layer. The photoreceptor of Comparative Example 2 in which the content of the sublimable antioxidant in all the charged-transporting layer in the single-layered charge-transporting layer was 21% and was low could not be resistant to oxidizing gas. The photoreceptor of Comparative Example 3 in which the content of the sublimable antioxidant in all the charge-transporting layer was 30% and was high was resistant to oxidizing gas, but its exposure potential VL was high both under the H/H condition and under the L/L condition, and its photo-responsiveness was poor.

The photoreceptors in which the charge-transporting layer is composed of a first charge-transporting layer and a second charge-transporting layer and in which the content of the sublimable antioxidant in the second charge-transporting layer is higher than the content of the sublimable antioxidant in the first charge-transporting layer (Examples 1 to 5) are resistant to oxidizing gas and have excellent electric properties. Of those, in the photoreceptors of Examples of 1, 3 and 5 in which the hindered phenol compound of the structural formula (1aa) was used as the sublimable antioxidant, the content of the sublimable antioxidant in the first charge-transporting layer was lowered, and the photoreceptors had excellent electric properties.

The photoreceptors of Examples 2 and 4 in which the hindered phenol compound of the structural formula (1ac) was used as the sublimable antioxidant are excellently resistant to oxidizing gas.

When Example 1 is compared with Example 2, then it is known that the sublimation temperature of the hindered phenol compound of the structural formula (1aa) is lower than that of the hindered phenol compound of the structural formula (1ac) as the molecular weight of the former is smaller than that of the latter, and therefore the content of the sublimable antioxidant in the first charge-generating layer in the former could be lowered further more and the photoreceptor of Example 1 has excellent electric properties. In addition, since the sublimation temperature of the hindered phenol compound of the structural formula (1aa) is lower than that of the hindered phenol compound of the structural formula (1ac), it was easy to control the content of the sublimable antioxidant. Accordingly, the heating temperature in the first drying step could be lower, and the energy cost necessary for the heating could be reduced.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method for producing an electrophotographic photoreceptor having at least a first photosensitive layer and a second photosensitive layer laminated in that order on a conductive substrate, the method comprising:

a first coating step of applying a coating liquid that contains a sublimable antioxidant and a photoconductive substance, onto a conductive substrate to thereby form a first coating film thereon;

a first drying step of drying the formed first coating film by heating to thereby form a first photosensitive layer;

a second coating step of applying the coating liquid used in the first coating step, onto the first photosensitive layer to thereby form a second coating film;

a second drying step of drying the formed second coating film by heating to thereby form a second photosensitive layer;

wherein, in the second drying step, the drying condition for the second coating film is made to differ from the drying condition for the first coating film in the first drying step so that a degree of sublimation of the antioxidant in the second drying step is lower than that of sublimation of the antioxidant in the first drying step.

2. The method of claim 1, wherein the photoconductive substance is a charge-transporting substance, the first photosensitive layer is a first charge-transporting layer, and the second photosensitive layer is a second charge-transporting layer.

3. The method of claim 1, wherein the sublimable antioxidant is a hindered phenol compound of the following general formula (1):

(1)

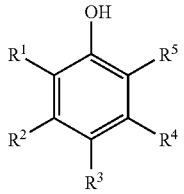

wherein $R^1$ represents a branched alkyl group; $R^2$ to $R^4$ each independently represent a hydrogen atom, a hydroxyl group, an alkyl group or an aryl group, and at least two of $R^2$ to $R^4$ may bond to each other to form a ring along with the carbon atoms bonding to $R^2$ to $R^4$; $R^5$ represents a branched alkyl group or an aryl group; wherein the sum total of the atomic weight of the atoms constituting $R^1$ to $R^5$ is from 117 to 400.

4. The method of claim 3, wherein the hindered phenol compound of the formula (1) is a hindered phenol compound of the following structural formula (1aa).

(1aa)

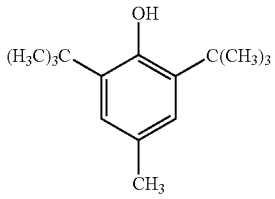

5. The method of claim 1, wherein in the first drying step, the first coating film is dried by heating at a heating temperature higher than 120° C. under normal pressure, in the second drying step, the second coating film is dried by heating at a heating temperature not higher than 120° C. under normal pressure.

* * * * *